US008508325B2

(12) United States Patent
Ueda et al.

(10) Patent No.: US 8,508,325 B2
(45) Date of Patent: Aug. 13, 2013

(54) CHIP VARISTOR AND CHIP VARISTOR MANUFACTURING METHOD

(75) Inventors: Kaname Ueda, Tokyo (JP); Katsunari Moriai, Tokyo (JP); Takahiro Itami, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 13/295,606

(22) Filed: Nov. 14, 2011

(65) Prior Publication Data

US 2012/0139688 A1 Jun. 7, 2012

(30) Foreign Application Priority Data

Dec. 6, 2010 (JP) ..... 2010-271326
Dec. 6, 2010 (JP) ..... 2010-271328

(51) Int. Cl.
*H01C 7/10* (2006.01)

(52) U.S. Cl.
USPC ..... 338/20; 338/21

(58) Field of Classification Search
USPC ..... 338/20, 21
See application file for complete search history.

(56) References Cited

U.S. PATENT DOCUMENTS 6,232,867 B1 5/2001 Yoshida et al.
6,400,253 B1 6/2002 Jinno et al.
7,649,435 B2 * 1/2010 Moriai et al. ..... 338/21
7,724,123 B2 * 5/2010 Matsuoka et al. ..... 338/21
7,864,025 B2 1/2011 Katsumura et al.
7,940,155 B2 * 5/2011 Katsumura et al. ..... 338/21
7,994,894 B2 * 8/2011 Sato et al. ..... 338/21

FOREIGN PATENT DOCUMENTS

JP U-1-93704 6/1989
JP A-2002-246207 8/2002
JP 2005-302937 10/2005
JP A-2006-344751 12/2006
JP A-2009-277801 11/2009

OTHER PUBLICATIONS

Office Action issued in Japanese Patent Application No. 2010-271326 mailed Jan. 8, 2013.
U.S. Appl. No. 13/587,326 in the name of Ueda at al., filed on Aug. 16, 2012.
U.S. Appl. No. 13/587,310 in the name of Ueda et al., filed on Aug. 16, 2012.
Apr. 29, 2013 Office Action issued in U.S. Appl. No. 13/587,310.
Apr. 30, 2013 Office Action issued in U.S. Appl. No. 13/587,326.

* cited by examiner

*Primary Examiner* — Kyung Lee
(74) *Attorney, Agent, or Firm* — Oliff & Berridge, PLC

(57) ABSTRACT

A chip varistor is provided with a varistor section, a plurality of electroconductive sections, and a plurality of terminal electrodes. The varistor section is comprised of a sintered body containing ZnO as a major component and exhibits the nonlinear voltage-current characteristics. The plurality of electroconductive sections are arranged on both sides of the varistor section and each electroconductive section has a first principal surface connected to the varistor section and a second principal surface opposed to the first principal surface. The terminal electrodes are connected to the respective second principal surfaces of the electroconductive sections.

6 Claims, 21 Drawing Sheets

CHIP VARISTOR AND CHIP VARISTOR MANUFACTURING METHOD

BACKGROUND OF THE INVENTION

1. Field of the Invention

The present invention relates to a chip varistor and a chip varistor manufacturing method.

2. Related Background Art

One of known chip varistors is a multilayer chip varistor provided with a varistor element body having a varistor layer and internal electrodes arranged with the varistor layer in between, and also provided with terminal electrodes arranged at ends of the varistor element body so as to be connected to the corresponding internal electrodes (e.g., cf Japanese Patent Application Laid-open No. 2002-246207). In the multilayer chip varistor, a region between the internal electrodes in the varistor layer functions as a region to exhibit the nonlinear voltage-current characteristics (hereinafter also referred to as "varistor characteristics").

SUMMARY OF THE INVENTION

However, the multilayer chip varistor described in Japanese Patent Application Laid-open No. 2002-246207 has the problem as described below because it has the internal electrodes.

When a surge voltage such as ESD (ElectroStatic Discharge) is applied to the multilayer chip varistor, an electric field distribution in portions where the internal electrodes overlap each other is concentrated at the edges of the overlap portions of the internal electrodes. When the electric field distribution in the overlap portions of the internal electrodes is concentrated at the edges, the resistance to ESD (hereinafter referred to as "ESD resistance") quickly degrades.

The multilayer chip varistors are generally produced as described below. Electrode patterns to become the internal electrodes are formed on varistor green sheets to become the varistor layers, and the varistor green sheets with the electrode patterns thereon and others are stacked to obtain a laminate body. Thereafter, the laminate body is cut and fired and the terminal electrodes are formed on each laminate body after fired. For this reason, the multilayer chip varistors could have variation in the area of the overlap portions of the internal electrodes because of such factors as the forming accuracy of the electrode patterns on the varistor green sheets, lamination deviation of the varistor green sheets, or cutting deviation of the laminate body. The variation in the area of the overlap portions of the internal electrodes can lead to variation in capacitance established by the overlap portions of the internal electrodes.

Since the multilayer chip varistor was provided with the internal electrodes as described above, it was difficult to maintain good ESD resistance and to suppress occurrence of variation in capacitance.

It is an object of the present invention to provide a chip varistor without inclusion of the internal electrodes capable of suppressing occurrence of variation in capacitance while maintaining good ESD resistance, and a manufacturing method of the chip varistor.

A chip varistor according to the present invention is a chip varistor comprising: a varistor section comprised of a sintered body containing ZnO as a major component and configured to exhibit the nonlinear voltage-current characteristics; a plurality of electroconductive sections arranged on both sides of the varistor section and each having a first principal surface connected to the varistor section and a second principal surface opposed to the first principal surface; and a plurality of terminal electrodes connected to the respective second principal surfaces of the plurality of electroconductive sections.

In the chip varistor according to the present invention, the varistor section is sandwiched in between the electroconductive sections and connected thereto, and the varistor section functions as a region to exhibit the varistor characteristics. Namely, the chip varistor of the present invention, different from the aforementioned multilayer chip varistor, exhibits the varistor characteristics, without inclusion of the internal electrodes. For this reason, even if a surge voltage such as ESD is applied to the chip varistor, the electric field distribution is concentrated nowhere in the varistor section, so as to cause no degradation of ESD resistance.

In the present embodiment, the chip varistor is not provided with the internal electrodes, and therefore the chip varistor is free of occurrence of variation in capacitance due to the internal electrodes. For this reason, it is feasible to prevent occurrence of variation in capacitance.

The electroconductive sections may contain ZnO as a major component. In this case, the varistor section and the electroconductive sections are comprised of sintered bodies containing ZnO as a major component, and therefore the connection strength becomes firm at interfaces between the varistor section and the electroconductive sections. As a result, the varistor section and the electroconductive sections are connected well, so as to prevent occurrence of delamination between the varistor section and the electroconductive sections.

Furthermore, the chip varistor may be configured as follows: the varistor section contains at least one element selected from the group consisting of rare earth metals and Bi, as a minor component; at least one electroconductive section out of the plurality of electroconductive sections is comprised of a sintered body substantially containing none of the rare earth metals and Bi, as a minor component. In this case, since the sintered bodies forming the electroconductive sections substantially contain none of the rare earth metals and Bi, the electroconductive sections are unlikely to exhibit the varistor characteristics, and thus they have relatively high electrical conductivity. Therefore, the function as electrodes is not hindered in the electroconductive sections.

The electroconductive sections may be comprised of a composite material of a metal and a metal oxide. In this case, heat in the chip varistor is readily dissipated through the electroconductive sections, whereby the chip varistor can be obtained with excellent heat dissipation. Since the varistor section and the electroconductive sections contain the metal oxide, the connection strength becomes firm at the interfaces between the varistor section and the electroconductive sections. As a result, the varistor section and the electroconductive sections are connected well, so as to prevent occurrence of delamination between the varistor section and the electroconductive sections.

The chip varistor may be configured as follows: the varistor section includes a first region in which at least one element selected from the group consisting of alkali metals, Ag, and Cu exists, and a second region extending between the first principal surfaces of the electroconductive sections and containing no element selected from the group consisting of alkali metals, Ag, and Cu; each of the electroconductive sections includes a first region in which at least one element selected from the group consisting of alkali metals, Ag, and Cu exists, and a second region extending between the first principal surface and the second principal surface and containing no element selected from the group consisting of alkali metals, Ag, and Cu.

In this case, each of the varistor section and the electroconductive sections comprised of the sintered bodies containing ZnO as a major component includes the first region in which at least one element selected from the group consisting of alkali metals, Ag, and Cu exists. In each of the varistor section and the electroconductive sections, the first region has the electric conductivity and relative permittivity lower than the second region without any element selected from the group consisting of alkali metals, Ag, and Cu. The capacitance of the chip varistor can be expressed by the sum of respective capacitances of the varistor section and the electroconductive sections located between the terminal electrodes. Therefore, when the varistor section and the electroconductive sections include the respective first regions, the respective capacitances of the varistor section and the electroconductive sections become lower, so as to decrease the capacitance of the chip varistor.

The first region of the varistor section may be located on the exterior surface side of the varistor section so as to surround the outer periphery of the second region of the varistor section, when viewed from a direction in which the varistor section is sandwiched in between the electroconductive sections. In this case, since the electric conductivity is lower on the external surface side of the varistor section, surface current is less likely to flow on the external surface of the varistor section. As a result, it is feasible to prevent occurrence of leak current.

A chip varistor manufacturing method according to the present invention is a chip varistor manufacturing method comprising: a step of preparing a laminate body in which conductor green layers and a varistor green layer are laminated together so that the varistor green layer to become a varistor section containing ZnO as a major component and configured to exhibit the nonlinear voltage-current characteristics is sandwiched in between the conductor green layers to become electroconductive sections; a step of cutting the laminate body to acquire a plurality of green element bodies; a step of firing the plurality of green element bodies to acquire a plurality of element bodies in each of which the varistor section is sandwiched in between the electroconductive sections; and a step of forming terminal electrodes on both end sides in a direction in which the varistor section is sandwiched in between the electroconductive sections, in each of the plurality of element bodies.

The chip varistor manufacturing method according to the present invention allows us to readily manufacture the chip varistors without inclusion of the internal electrodes capable of suppressing occurrence of variation in capacitance while maintaining good ESD resistance.

The manufacturing method may further comprise a step of diffusing at least one element selected from the group consisting of alkali metals, Ag, and Cu, through the exterior surface of the element body, in each of the plurality of element bodies. In this case, since at least one element selected from the group consisting of alkali metals, Ag, and Cu is made to diffuse through the exterior surface of the element body, it is easy to control the range of diffusion of the at least one element selected from the group consisting of alkali metals, Ag, and Cu.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

The preferred embodiments of the present invention will be described below in detail with reference to the accompanying drawings. In the description the same elements or elements with the same functionality will be denoted by the same reference signs, without redundant description.

(First Embodiment)

Figure 1:
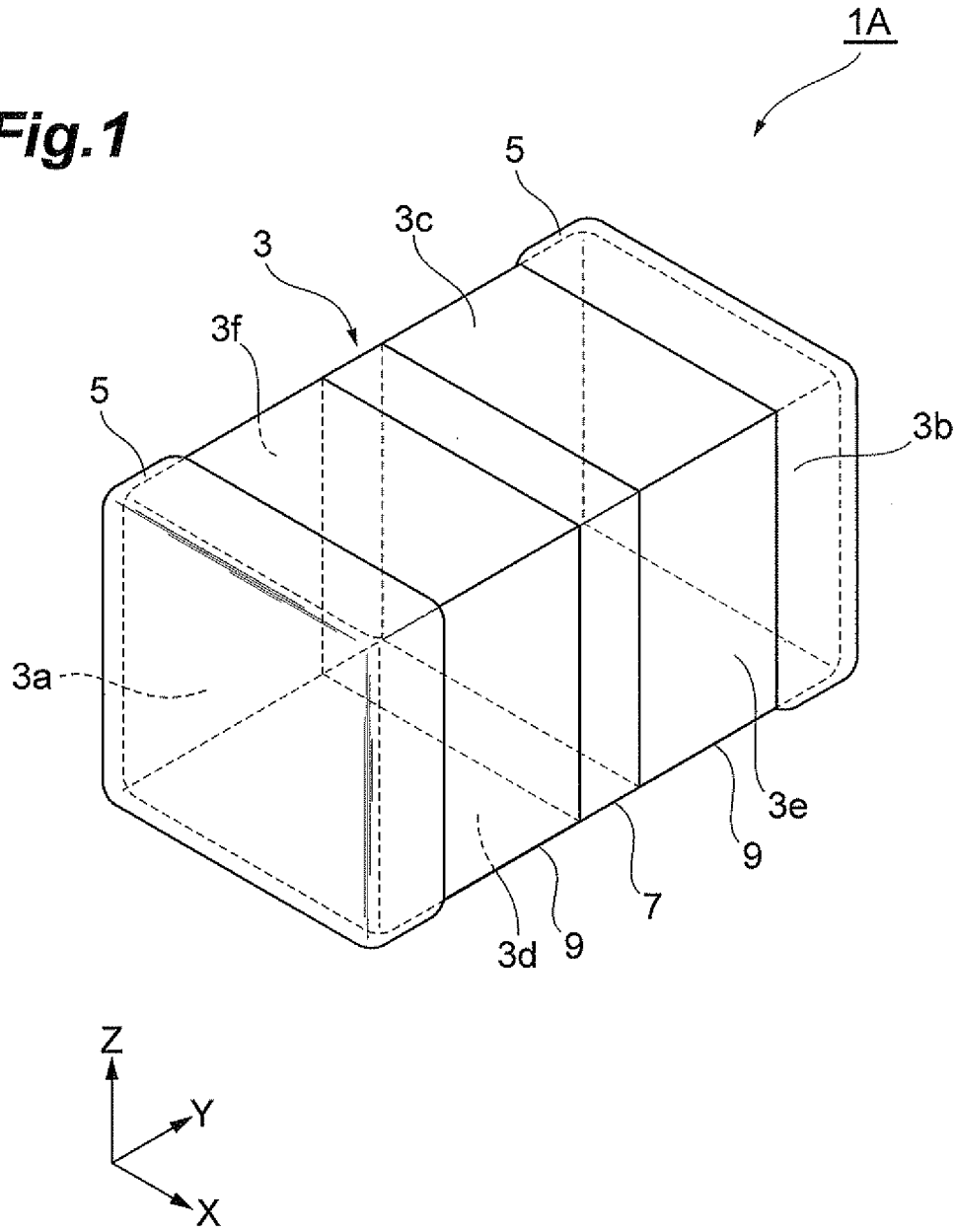
FIG. 1 is a perspective view showing a chip varistor according to the first embodiment.
Figure 2:
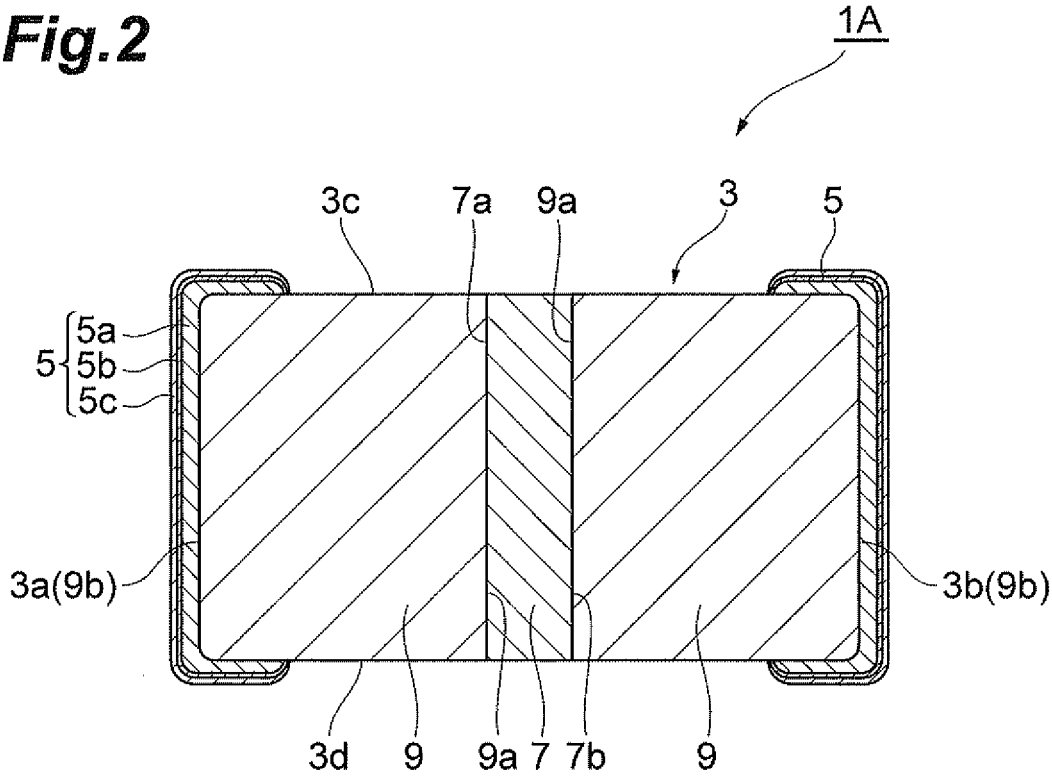
FIG. 2 is a drawing for explaining a cross-sectional configuration of the chip varistor according to the first embodiment.

First, a configuration of chip varistor 1 A according to the first embodiment will be described with reference to FIGS. 1 and 2. FIG. 1 is a perspective view showing the chip varistor according to the first embodiment. FIG. 2 is a drawing for explaining a cross-sectional configuration of the chip varistor according to the first embodiment.

The chip varistor 1A, as shown in FIG. 1, is provided with an element body 3 of a nearly rectangular parallelepiped shape and a pair of terminal electrodes 5 formed at two ends of the element body 3. The chip varistor 1A is, for example, a chip varistor of an extremely small size (so called 0402 size) having the length of 0.4 mm in the Y-direction, the height of 0.2 mm in the Z-direction, and the width of 0.2 mm in the X-direction in the drawing.

The element body 3 has a varistor section 7, and a plurality of electroconductive sections 9 (two electroconductive sections in the present embodiment). The element body 3 has end faces 3*a*, 3*b* of a square shape opposed to each other, and four side faces 3*c*-3*f* perpendicular to the end faces 3*a*, 3*b*, as its exterior surface. The four side faces 3*c*-3*f* extend so as to connect the end faces 3*a*, 3*b*.

The varistor section 7, as shown in FIGS. 1 and 2, is a portion of a rectangular parallelepiped shape located nearly in the center of the element body 3 and is comprised of a sintered body (semiconductor ceramic) to exhibit the varistor characteristics. The varistor section 7 includes a pair of principal surfaces 7*a*, 7*b* opposed to each other in its thickness direction (or the Y-direction in the drawing). The thickness of the varistor section 7 is set, for example, in the range of about 5 to 200 μm.

The varistor section 7 contains ZnO (zinc oxide) as a major component and also contains minor components of metals such as Co, rare earth metals, Group IIIb elements (B, Al, Ga, In), Si, Cr, Mo, alkali metals (K, Rb, Cs), and alkaline-earth metals (Mg, Ca, Sr, Ba), or oxides thereof. In the present embodiment the varistor section 7 contains Co, Pr, Cr, Ca, K, and Al as minor components. There are no particular restrictions on the content of ZnO in the varistor section 7, but it is usually from 99.8 to 69.0% by mass when the total content of all materials making up the varistor section 7 is 100% by mass.

The rare earth metal (e.g., Pr) acts as a substance to exhibit the varistor characteristics. The content of the rare earth metal in the varistor section 7 is set, for example, in the range of about 0.01 to 10 atomic %.

The electroconductive sections 9, as shown in FIGS. 1 and 2, are portions of a nearly rectangular parallelepiped shape located in regions nearer to the two ends of the element body 3. The electroconductive sections 9 are arranged on both sides of the varistor section 7 with the varistor section 7 in between. The electroconductive sections 9 have respective principal surfaces 9*a* connected to the varistor section 7 (principal surface 7*a* or 7*b*), and respective principal surfaces 9*b* opposed to the corresponding principal surfaces 9*a*. In the present embodiment the principal surfaces 7*a*, 7*b* of the varistor section 7 are almost entirely in contact with the principal surfaces 9*a* of the electroconductive sections 9 to be connected thereto. The principal surfaces 9*a* of the electroconductive sections 9 have the shape nearly identical to that of the principal surfaces 7*a*, 7*b* of the varistor section 7. The principal surfaces 9*b* of the electroconductive sections 9 constitute the end faces 3*a*, 3*b* of the element body 3. The principal surfaces 9*a* of the electroconductive sections 9 function as electrode faces to the varistor section 7.

The electroconductive sections 9 are comprised of sintered bodies containing ZnO as a principal component. The resistivity of ZnO is from 1 to 10 Ω·cm and thus ZnO has relatively high electrical conductivity. For this reason, the electroconductive sections 9 function as electrodes. The electroconductive sections 9 may contain metals such as Co, Group IIIb elements (B, Al, Ga, In), Si, Cr, Mo, alkali metals (K, Rb, Cs), and alkaline-earth metals (Mg, Ca, Sr, Ba) or oxides thereof as minor components, for adjustment of resistivity. There are no particular restrictions on the content of ZnO in the electroconductive sections 9, but it is, for example, from 100 to 69.0% by mass when the total content of materials making up the electroconductive sections 9 is 100% by mass.

If the electroconductive sections 9 should substantially contain a rare earth metal, the electroconductive sections 9 could exhibit the varistor characteristics. For this reason, the electroconductive sections 9 preferably substantially contain no rare earth metal. When the electroconductive sections 9 substantially contain no rare earth metal, they are unlikely to exhibit the varistor characteristics. Therefore, the electroconductive sections 9 have low electric resistance and relatively high electrical conductivity. The state in which "the electroconductive sections substantially contain no rare earth metal" refers to a state in which any rare earth metal was not intentionally added in raw materials in preparing the materials making up the electroconductive sections 9. For example, a case such that one or more of rare earth metals are contained unintentionally because of diffusion from the varistor section 7 into the electroconductive sections 9 corresponds to the state in which "the electroconductive sections 9 substantially contain no rare earth metal."

The terminal electrodes 5 are formed in multiple layers so as to cover the respective end faces 3*a*, 3*b* of the element body 3 (the principal surfaces 9*b* of the electroconductive sections 9). Each terminal electrode 5 has a first electrode layer 5*a*, a second electrode layer 5*b*, and a third electrode layer 5*c*. The first electrode layer 5*a* is connected directly to the corresponding electroconductive section 9 of the element body 3 and contains an electroconductive powder consisting mainly of Ag or the like, and a glass frit. The second electrode layer 5*b* is formed so as to cover the first electrode layer 5*a* and consists mainly of Ni. The third electrode layer 5*c* is formed so as to cover the second electrode layer 5*b* and consists mainly of Sn.

Figure 3:
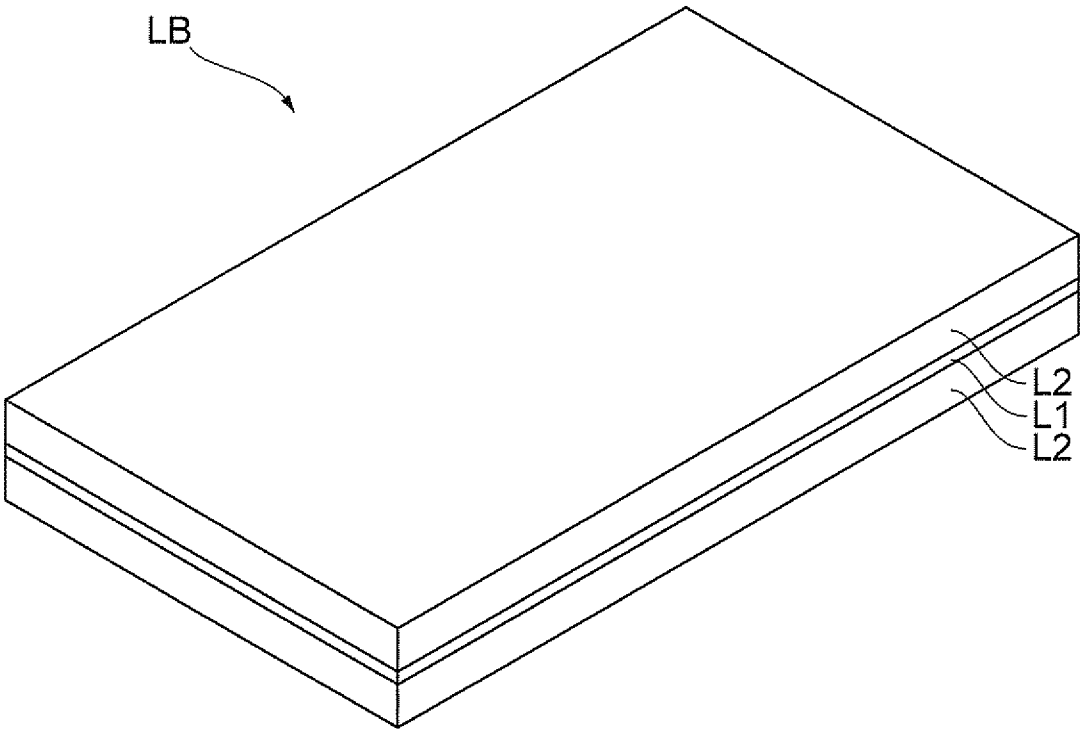
FIG. 3 is a drawing for explaining a manufacturing process of the chip varistors according to the first embodiment.
Figure 4:
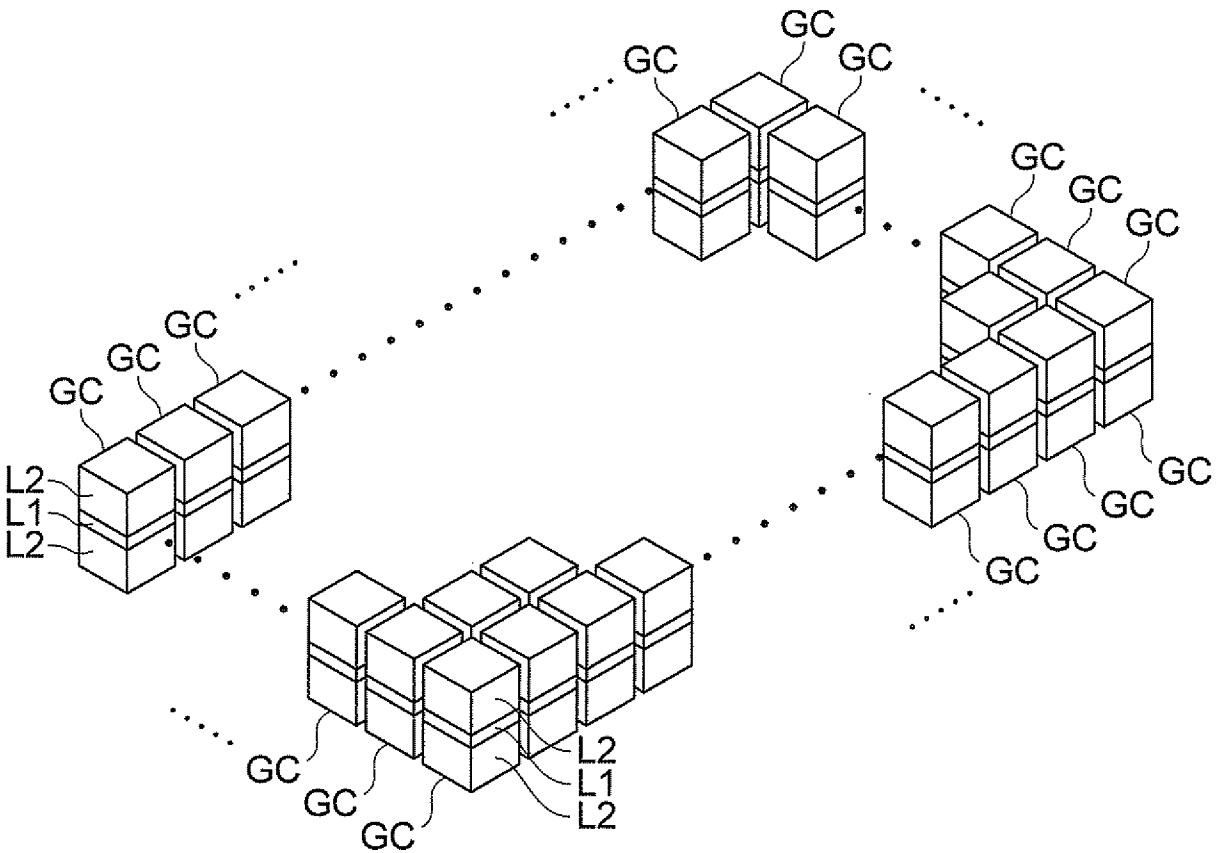
FIG. 4 is a drawing for explaining the manufacturing process of the chip varistors according to the first embodiment.

An example of a manufacturing process of chip varistors 1A having the above-described configuration will be described below with reference to FIGS. 3 and 4. FIGS. 3 and 4 are drawings for explaining the manufacturing process of the chip varistors according to the first embodiment.

First, ZnO as the major component of the varistor section 7, and the trace additives such as metals or oxides of Co, Pr, Cr, Ca, K, and Al each are weighed at a predetermined ratio and then these components are mixed to prepare a varistor material. Thereafter, further additives such as an organic binder, an organic solvent, and an organic plasticizer are added in this varistor material and they are mixed and pulverized with a ball mill or the like to obtain a slurry. This slurry is applied onto films, e.g., of polyethylene terephthalate by a known method such as the doctor blade method, and dried to form membranes in a predetermined thickness (e.g., about 30 μm).

The membranes obtained as described above are peeled off from the films to obtain first green sheets.

Furthermore, additives such as an organic binder, an organic solvent, and an organic plasticizer are added in the component of ZnO of the electroconductive sections 9, and they are mixed and pulverized with a ball mill or the like to obtain a slurry. When the electroconductive sections 9 are made to contain the aforementioned minor components in addition to ZnO, ZnO and additives making up the minor components are weighed at a predetermined ratio and then the components are mixed to prepare a material for the electroconductive sections 9. Further additives such as an organic binder, an organic solvent, and an organic plasticizer are added in the material for the electroconductive sections 9 and they are mixed and pulverized with a ball mill or the like to obtain a slurry. This slurry is applied onto films, e.g., of polyethylene terephthalate by a known method such as the doctor blade method, and then dried to form membranes in a predetermined thickness (e.g., about 30 μm). The membranes obtained in this manner are peeled of from the films to obtain second green sheets.

Next, the first green sheets and the second green sheets are stacked each by a predetermined number to form a lamination of a varistor green layer consisting of the first green sheets and conductor green layers consisting of the second green sheets so that the varistor green layer is sandwiched in between the conductor green layers. Thereafter, the stacked green sheets are pressed under pressure to compressively bond the green sheets to each other. The thickness of the varistor green layer is adjusted by the number of first green sheets. The thickness of each of the conductor green layers is adjusted by the number of second green sheets. The number of first green sheets may be at least one.

The above steps result in preparing a laminate body LB in which the varistor green layer L1 and the conductor green layers L2 are laminated together, as shown in FIG. 3.

Next, the laminate body LB is dried and thereafter, as shown in FIG. 4, it is cut in chip units to obtain a plurality of green element bodies GC (element bodies 3 before fired). The cutting of the laminate body LB is performed, for example, with a dicing saw or the like.

Next, the plurality of green element bodies GC are subjected to a thermal treatment under predetermined conditions (e.g., 180-400° C. and 0.5 to 24 hours) to implement debindering, and thereafter further fired under predetermined conditions (e.g., 1000-1400° C. and 0.5 to 8 hours). This firing process results in turning the varistor green layer L1 of the first green sheets into the varistor section 7 and turning the conductor green layers L2 of the second green sheets into the electroconductive sections 9, thereby obtaining a plurality of element bodies 3 in each of which the varistor section 7 is sandwiched in between the electroconductive sections 9. The varistor green layer L1 and the conductor green layers L2 are fired together. After the firing process, the element bodies 3 may be polished by barrel polishing if necessary. The barrel polishing may be carried out before the firing, i.e., after the cutting of the laminate body LB.

Next, an electroconductive paste is applied so as to cover the two end faces 3*a*, 3*b* of each element body 3 and thermally treated to bake the electroconductive paste on the element body 3 to form the first electrode layers 5*a*. Thereafter, electroplating treatments such as Ni plating and Sn plating are carried out so as to cover the first electrode layers 5*a*, thereby forming the second and third electrode layers 5*b*, 5*c*. These result in forming the terminal electrodes 5 on the both end sides of the element body 3. The terminal electrodes 5 are formed on both end sides in the direction in which the varistor section 7 is sandwiched in between the electroconductive sections 9, in the element body 3. The electroconductive paste can be, for example, one in which a glass fit and an organic vehicle are mixed in a metal powder. The metal powder can be, for example, one containing Cu, Ag, or an Ag—Pd alloy as a major component.

The chip varistors 1A are obtained through these steps.

In the present embodiment, as described above, the varistor section 7 is sandwiched in between the electroconductive sections 9 and connected thereto and the varistor section 7 functions as a region to exhibit the varistor characteristics. Namely, the chip varistor 1A, different from the so-called multilayer chip varistors, exhibits the varistor characteristics, without inclusion of the internal electrodes. For this reason, even if a surge voltage such as ESD is applied to the chip varistor 1A, the electric field distribution will be concentrated nowhere in the varistor section 7, so as to cause no degradation of ESD resistance.

In the present embodiment, the chip varistor 1A is not provided with any internal electrodes, so as to be free of variation in capacitance due to the internal electrodes. For this reason, it is feasible to suppress occurrence of variation in capacitance.

In the present embodiment, since the varistor section 7 and the electroconductive sections 9 are comprised of the sintered bodies consisting mainly of ZnO, the connection strength becomes firm at the interfaces between the varistor section 7 and the electroconductive sections 9. As a result, the varistor section 7 and the electroconductive sections 9 are connected well, so as to prevent occurrence of delamination between the varistor section 7 and the electroconductive sections 9.

In the present embodiment, the electroconductive sections 9 are comprised of the sintered bodies containing ZnO as a major component and substantially containing no rare earth metal, while the varistor section 7 contains the rare earth metal as a minor component. Since the electroconductive sections 9 (sintered bodies) substantially contain no rare earth metal, they are unlikely to exhibit the varistor characteristics and thus have relatively high electrical conductivity. Therefore, the function as electrodes is not hindered in the electroconductive sections 9.

Figure 5:
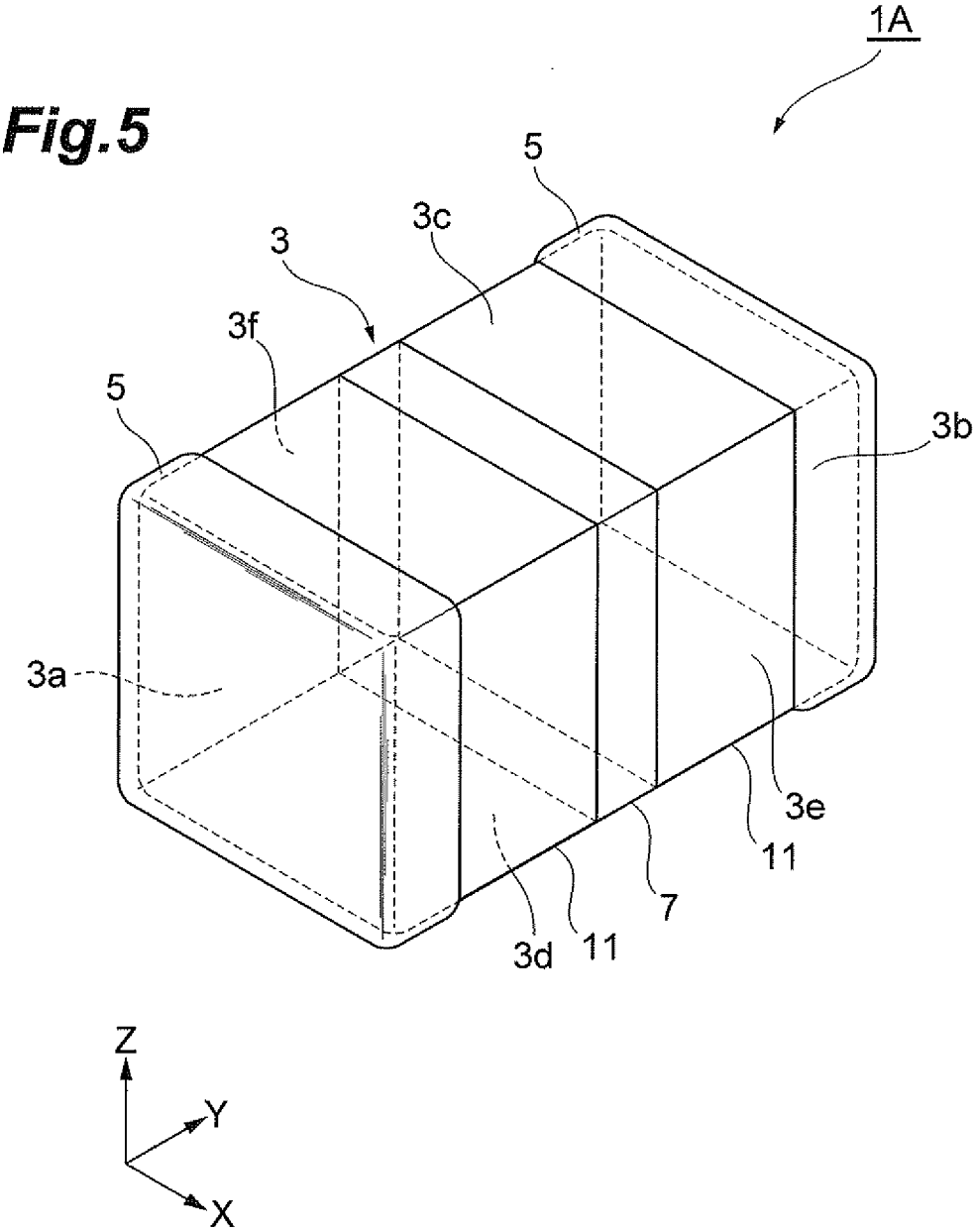
FIG. 5 is a perspective view showing a chip varistor according to a modification example of the first embodiment.
Figure 6:
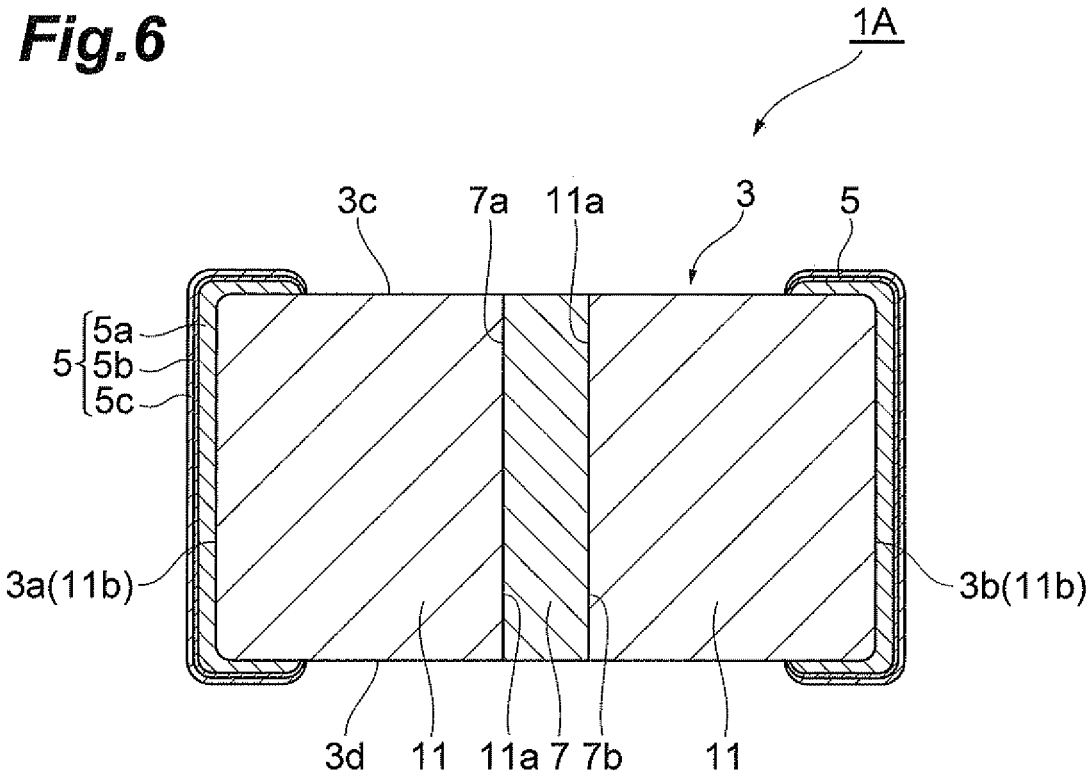
FIG. 6 is a drawing for explaining a cross-sectional configuration of the chip varistor according to the modification example of the first embodiment.

The below will describe a configuration of chip varistor 1A according to a modification example of the present embodiment, with reference to FIGS. 5 and 6. FIG. 5 is a perspective view showing the chip varistor according to the modification example of the first embodiment. FIG. 6 is a drawing for explaining a cross-sectional configuration of the chip varistor according to the modification example of the first embodiment.

The chip varistor 1A of the modification example, as shown in FIG. 5, is also provided with an element body 3 of a nearly rectangular parallelepiped shape, and a pair of terminal electrodes 5 formed at two ends of the element body 3. The element body 3 has a varistor section 7 and a plurality of composite sections 11 (two composite sections in the present embodiment).

The composite sections 11, as shown in FIGS. 5 and 6, are portions of a nearly rectangular parallelepiped shape located in regions nearer to the two ends of the element body 3. The composite sections 11 are arranged on both sides of the varistor section 7 with the varistor section 7 in between. Each composite section 11 has a principal surface 11*a* connected to the varistor section 7 (principal surface 7*a* or 7*b*) and a principal surface 11*b* opposed to the principal surface 11*a*. In the present modification example, the principal surfaces 7*a*, 7*b* of the varistor section 7 are almost entirely in contact with the respective principal surfaces 11*a* of the composite sections 11 to be connected thereto. The principal surfaces 11*a* of the composite sections 11 have the shape approximately identical to that of the principal surfaces 7*a*, 7*b* of the varistor section 7. The principal surfaces 11*b* of the composite sections 11 constitute the end faces 3*a*, 3*b* of the element body 3. The principal surfaces 11*a* of the composite sections 11 function as electrode faces to the varistor section 7.

Figure 7:
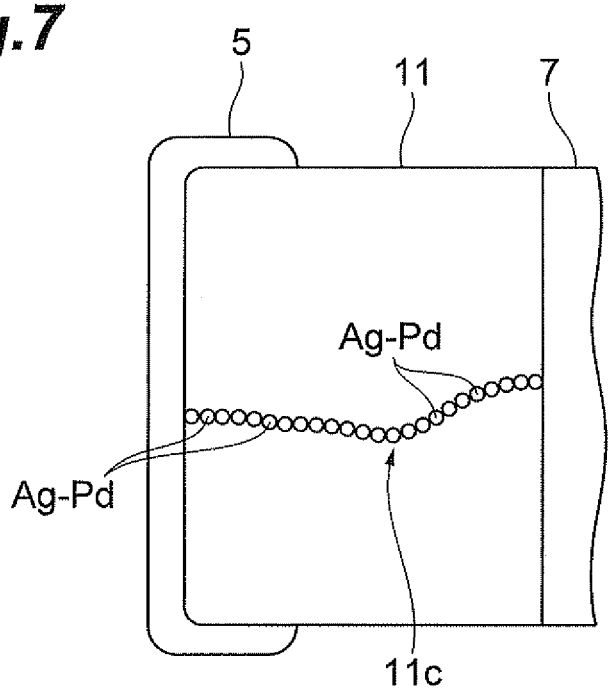
FIG. 7 is a schematic cross-sectional view showing an electroconductive passage in a composite section of the chip varistor according to the first embodiment.

The composite sections 11 are comprised of a composite material of an Ag—Pd alloy and ZnO. In the composite material making up the composite sections 11, the Ag—Pd alloy is in a state in which it is dispersed in ZnO, and the Ag—Pd alloy forms electroconductive passages 11*c* between the terminal electrodes 5 and the varistor section 7, as shown in FIG. 7. FIG. 7 shows only one conductive passage 11*c*, for easier description, but in fact a large number of conductive passages 11*c* are formed in each composite section 11. Namely, the composite sections 11 function as electroconductive sections.

The content of ZnO in the composite sections 11 is, for example, from 10 to 80% by mass when the total content of the materials making up the composite sections 11 is 100% by mass. The content of the Ag—Pd alloy in the composite sections 11 is, for example, from 20 to 90% by mass when the total content of the materials making up the composite sections 11 is 100% by mass. The composite sections 11 may contain any one of Ag, Au, Pd, and Pt, instead of the Ag—Pd alloy, as a metal contained therein. The metal oxide contained in the composite sections 11 is preferably ZnO which is the same as the metal oxide contained in the varistor section 7, but the metal oxide may be another metal oxide such as CoO, NiO, or $TiO_2$, instead of ZnO.

Figure 8:
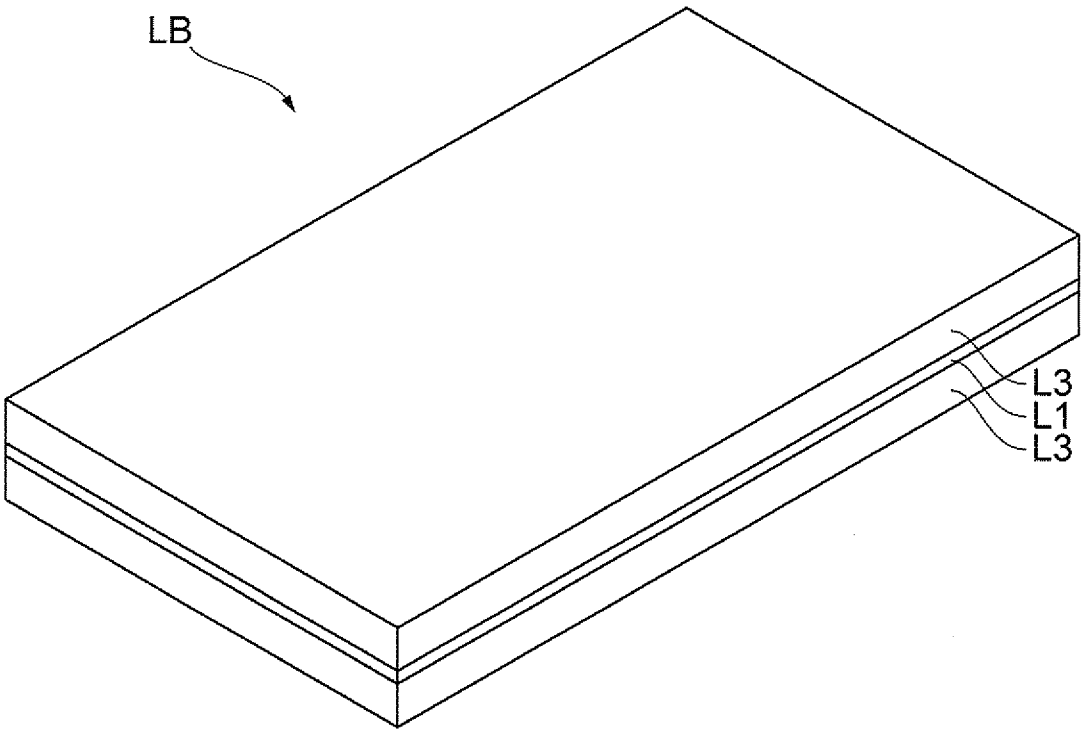
FIG. 8 is a drawing for explaining a manufacturing process of the chip varistors according to the modification example of the first embodiment.
Figure 9:
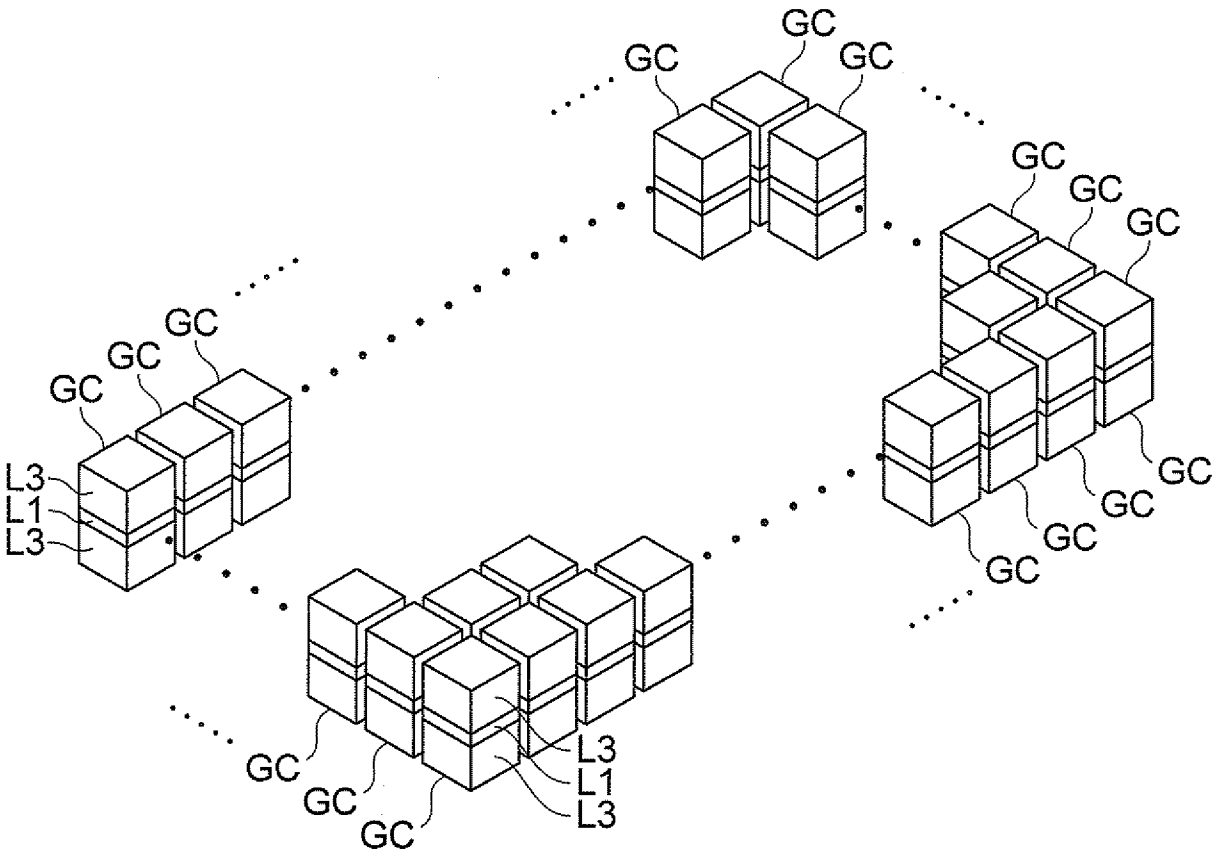
FIG. 9 is a drawing for explaining the manufacturing process of the chip varistors according to the modification example of the first embodiment.

The below will describe an example of a manufacturing process of the chip varistors 1A according to the present modification example, with reference to FIGS. 8 and 9. FIGS. 8 and 9 are drawings for explaining the manufacturing process of the chip varistors according to the modification example of the first embodiment.

First, the first green sheets are obtained in the same manner as in the aforementioned embodiment. Furthermore, ZnO and the Ag—Pd alloy making up the composite sections 11 are weighed at a predetermined ratio and then they are mixed to prepare a material for the composite sections 11. Thereafter, additives such as an organic binder, an organic solvent, and an organic plasticizer are added in the material for the composite sections 11 and then they are mixed and pulverized with a ball mill or the like to obtain a slurry. This slurry is applied onto films, for example, of polyethylene terephthalate by a known method such as the doctor blade method and thereafter dried to form membranes in a predetermined thickness (e.g., about 30 μm). The membranes obtained in this manner are peeled off from the films to obtain the second green sheets.

Next, the first green sheets and the second green sheets are stacked each by a predetermined number to form a lamination of a varistor green layer consisting of the first green sheets and composite green layers consisting of the second green sheets so that the varistor green layer is sandwiched in between the composite green layers. Thereafter, the laminated green sheets are pressed under pressure to compressively bond the green sheets to each other. The thickness of each of the composite green layers is adjusted by the number of second green sheets as in the case of the conductor green layers.

The above steps result in preparing a laminate body LB in which the varistor green layer L1 and the composite green layers L3 are laminated together, as shown in FIG. 8.

Next, the laminate body LB is dried and then it is cut in chip units, as shown in FIG. 9, to obtain a plurality of green element bodies GC (element bodies 3 before fired).

Next, the plurality of green element bodies GC are subjected to a thermal treatment under predetermined conditions (e.g., 180 to 400° C. and 0.5 to 24 hours) to implement debindering, and then are further fired under predetermined conditions (e.g., 1000 to 1400° C. and 0.5 to 8 hours). This firing process results in turning the varistor green layer L1 of the first green sheets into the varistor section 7 and turning the composite green layers L3 of the second green sheets into the composite sections 11, thereby obtaining a plurality of element bodies 3 in each of which the varistor section 7 is sandwiched in between the composite sections 11. The varistor green layer L1 and the composite green layers L3 are fired together.

Next, the terminal electrodes 5 are formed on each element body 3 (composite sections 11) in the same manner as in the foregoing embodiment.

The chip varistors 1A of the modification example are obtained through these steps.

In the present modification example, as described above, the varistor section 7 is also sandwiched in between the composite sections 11 and connected thereto, whereby the varistor section 7 functions as the region to exhibit the varistor characteristics. Namely, the chip varistor 1A, different from the so-called multilayer chip varistors, exhibits the varistor characteristics, without inclusion of the internal electrodes. For this reason, even if a surge voltage such as ESD is applied to the chip varistor 1A, the electric field distribution will be concentrated nowhere in the varistor section, so as to cause no degradation of ESD resistance.

In the present modification example, the chip varistor 1A is not provided with any internal electrodes, either, whereby it is feasible to suppress occurrence of variation in capacitance.

In the present modification example, since the composite sections 11 are comprised of the composite material of the Ag—Pd alloy and ZnO, heat in the chip varistor 1A is readily dissipated through the composite sections. This allows us to obtain the chip varistor 1A with excellent heat dissipation.

In the present modification example, the varistor section 7 and the composite sections 11 contain ZnO, whereby the connection strength becomes firm at the interfaces between the varistor section 7 and the composite sections 11. For this reason, the varistor section 7 and the composite sections 11 are connected well, and it is thus feasible to prevent occurrence of delamination between the varistor section 7 and the composite sections 11.

The chip varistor 1A according to each of the present embodiment and the modification example is mounted by soldering so that the opposing direction of the electroconductive sections 9 becomes parallel to a mounting surface of an external board or the like. When viewed in the opposing direction of the electroconductive sections 9 or the composite sections 11, the varistor section 7 is located approximately in the center of the element body 3, and therefore a solder is less likely to reach the varistor section 7 on the occasion of a soldering. As a result, the chip varistor 1A can prevent the solder from adhering to the varistor section 7 in solder mounting and thereby impeding the function of the varistor section 7.

(Second Embodiment)

Figure 10:
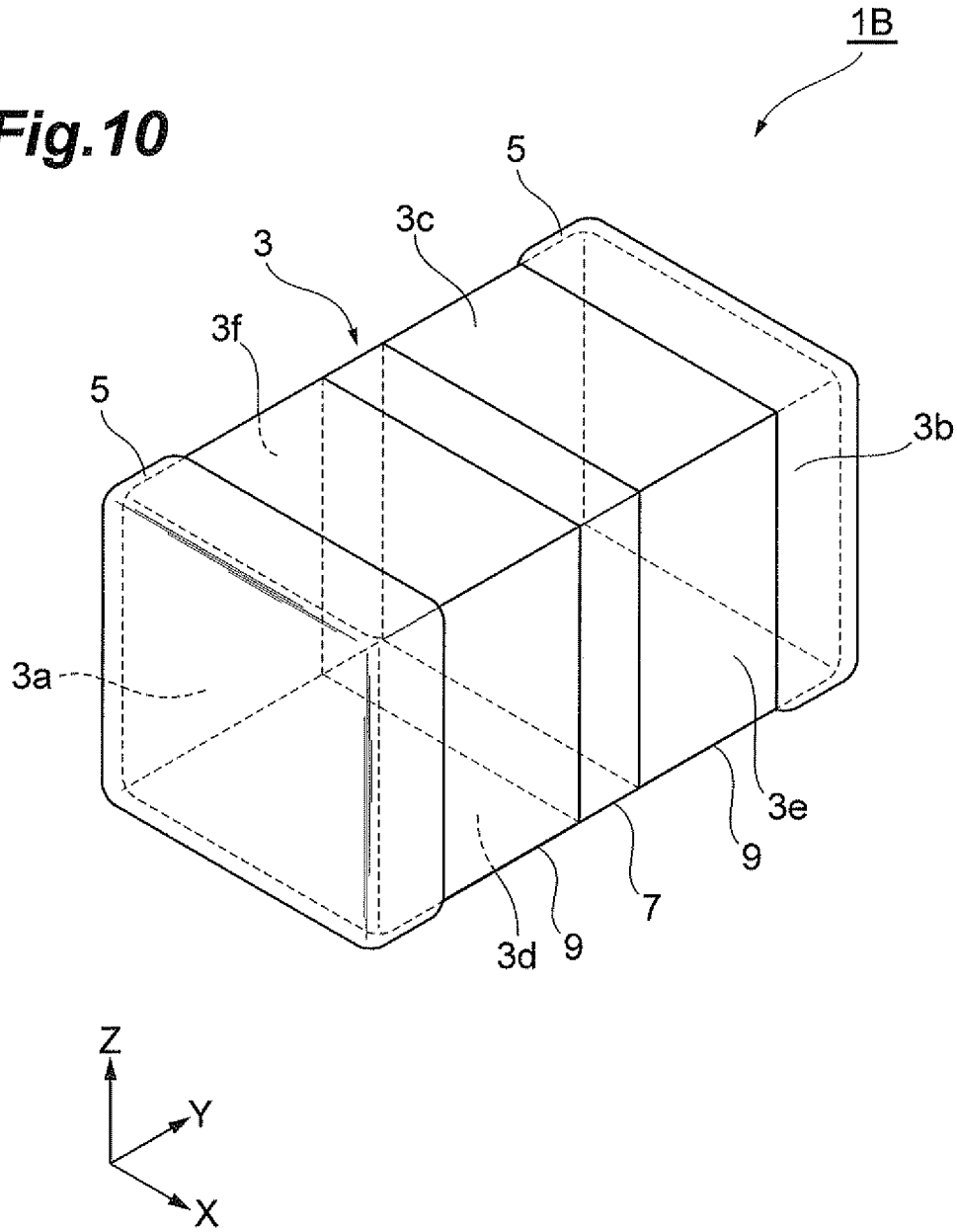
FIG. 10 is a perspective view showing a chip varistor according to the second embodiment.
Figure 11:
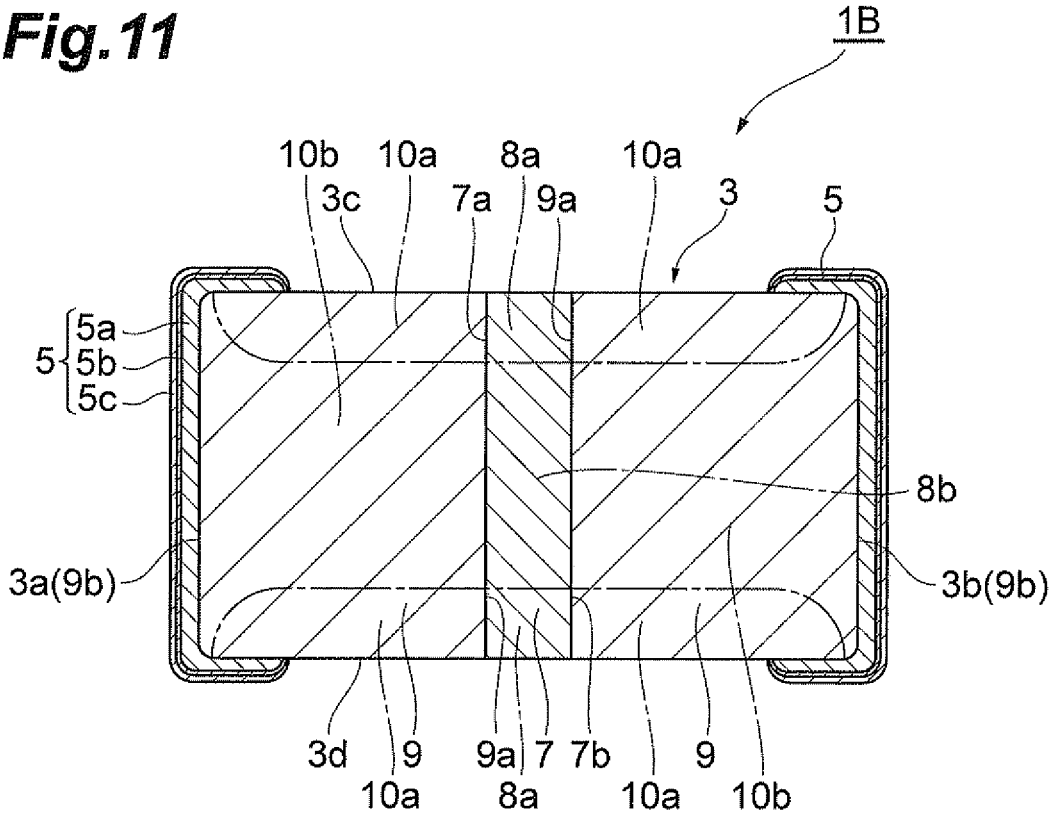
FIG. 11 is a drawing for explaining a cross-sectional configuration of the chip varistor according to the second embodiment.
Figure 12:
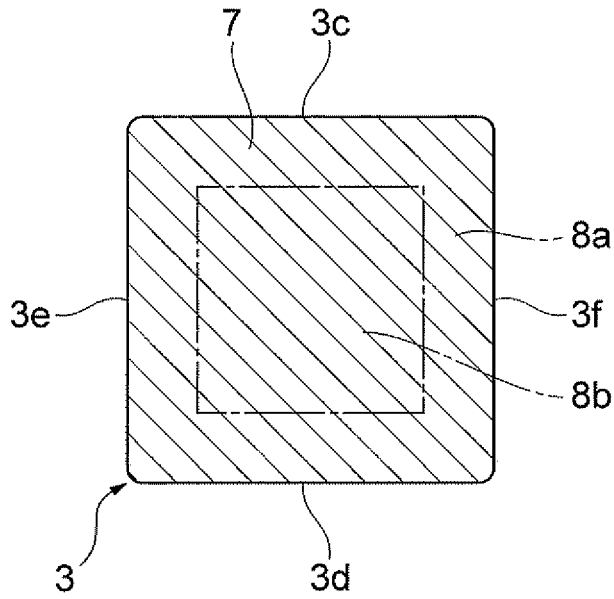
FIG. 12 is a drawing for explaining a cross-sectional configuration of a varistor section in the chip varistor according to the second embodiment.
Figure 13:
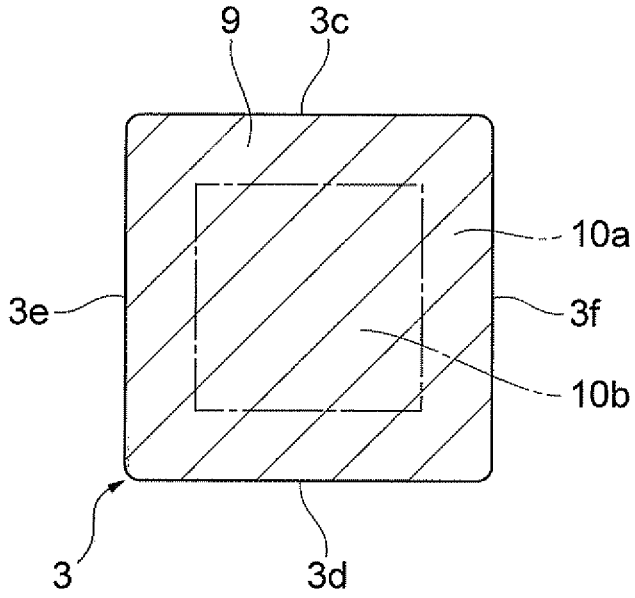
FIG. 13 is a drawing for explaining a cross-sectional configuration of an electroconductive section in the chip varistor according to the second embodiment.

First, a configuration of chip varistor 1B according to the present embodiment will be described with reference to FIGS. 10 to 13. FIG. 10 is a perspective view showing the chip varistor according to the second embodiment. FIG. 11 is a drawing for explaining a cross-sectional configuration of the chip varistor according to the second embodiment. FIG. 12 is a drawing for explaining a cross-sectional configuration of a varistor section in the chip varistor according to the second embodiment. FIG. 13 is a drawing for explaining a cross-sectional configuration of an electroconductive section in the chip varistor according to the second embodiment.

The chip varistor 1B, as shown in FIGS. 10 and 11, is provided with an element body 3 of a nearly rectangular parallelepiped shape, and a pair of terminal electrodes 5 formed at two ends of the element body 3. The chip varistor 1B is, for example, a chip varistor of an extremely small size (so called 0402 size) having the length of 0.4 mm in the Y-direction, the height of 0.2 mm in the Z-direction, and the width of 0.2 mm in the X-direction in the drawing.

The element body 3 has a varistor section 7 and a plurality of electroconductive sections 9 (two electroconductive sections in the present embodiment).

In the present embodiment, each of the varistor section 7 and the electroconductive sections 9, as also shown in FIGS. 12 and 13, includes a first region 8*a*, 10*a* and a second region 8*b*, 10*b*, respectively. The first regions 8*a*, 10*a* contain at least one element selected from the group consisting of alkali metals, Ag, and Cu. In the first regions 8*a*, 10*a*, the at least one element selected from the group consisting of alkali metals, Ag, and Cu exists in a solid solution form in crystal grains of ZnO or exists at crystal grain boundaries of ZnO. In the second regions 8*b*, 10*b*, there is no element selected from the group consisting of alkali metals, Ag, and Cu. In the present embodiment, the foregoing element to be used is an alkaline metal, particularly, Li. Li has the relatively small ion radius, is easy to form a solid solution in crystal grains of ZnO, and also has a high diffusion rate. In the first regions 8*a*, 10*a* there may be two or more elements selected from the group consisting of alkali metals, Ag, and Cu.

In the varistor section 7, the second region 8*b* is located nearly in the center of the varistor section 7, when viewed from the opposing direction of the pair of principal surfaces 7*a*, 7*b*, as shown in FIG. 12. The second region 8*b* extends between the principal surface 7*a* and the principal surface 7*b* when viewed from a direction perpendicular to the opposing direction of the pair of principal surfaces 7*a*, 7*b*. Namely, the second region 8*b* extends between the principal surfaces 9*a* of the electroconductive sections 9 to be connected to the electroconductive sections 9 (principal surfaces 9*a*). The first region 8*a* is located on the exterior surface side of the varistor section 7 so as to surround the outer periphery of the second region 8*b*, when viewed from the opposing direction of the pair of principal surfaces 7*a*, 7*b*.

In each of the electroconductive sections 9, the second region 10*b* is located nearly in the center of the electroconductive section 9, when viewed from the opposing direction of the pair of principal surfaces 9*b*, as shown in FIG. 13. The second region 10*b* extends between the principal surface 9*a* and the principal surface 9*b*, when viewed from the direction perpendicular to the opposing direction of the pair of principal surfaces 9*b*. Namely, the second region 10*b* is connected to the second region 8*b* of the varistor section 7 and to the terminal electrode 5. The first region 10*a* is located on the exterior surface side of the electroconductive section 9 so as to surround the outer periphery of the second region 10*b*, when viewed from the opposing direction of the pair of principal surfaces 9*b*.

When the element selected from the group consisting of alkali metals, Ag, and Cu exists in the solid solution form in the crystal grains of ZnO, the element reduces donors in ZnO demonstrating the property as an n-type semiconductor. For this reason, ZnO comes to have lower electric conductivity and becomes less likely to exhibit the varistor characteristics. It is also considered that the electric conductivity becomes lower when the foregoing element exists at crystal grain boundaries of ZnO. Therefore, the first regions 8*a*, 10*a* have lower electric conductivity and lower capacitance than the second regions 8*b*, 10*b*. In the varistor section 7 the second region 8*b* functions mainly as a region to exhibit the varistor characteristics. In the electroconductive sections 9 the second regions 10*b* function mainly as electrodes (conductors).

Figure 14:
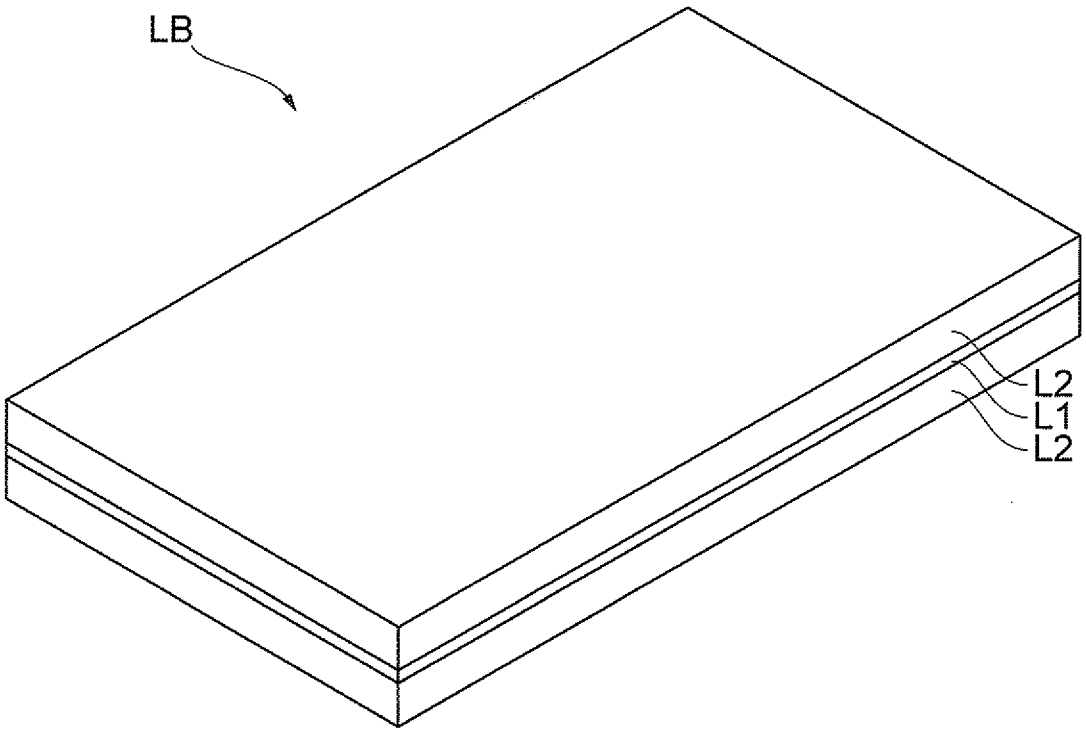
FIG. 14 is a drawing for explaining a manufacturing process of the chip varistors according to the second embodiment.
Figure 15:
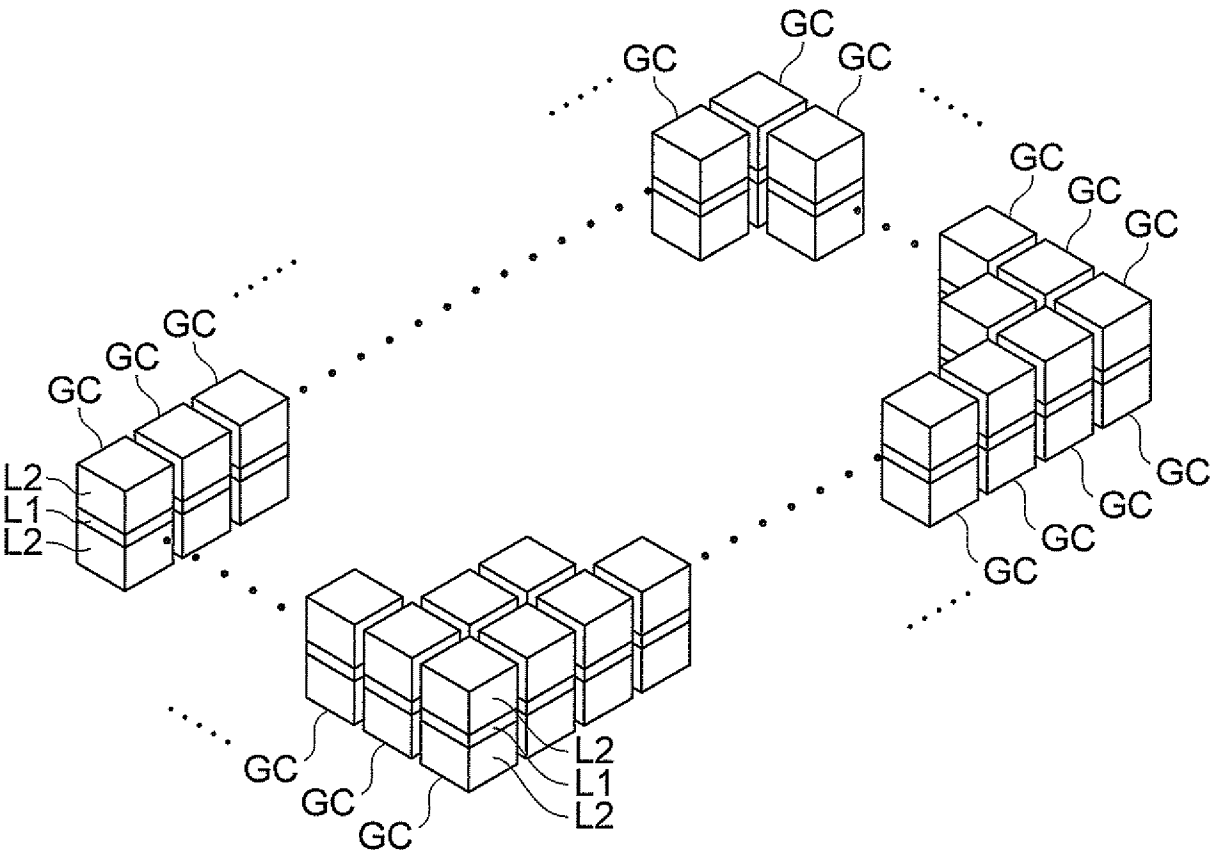
FIG. 15 is a drawing for explaining the manufacturing process of the chip varistors according to the second embodiment.

The below will describe an example of a manufacturing process of the chip varistors 1B having the above-described configuration, with reference to FIGS. 14 and 15. FIGS. 14 and 15 are drawings for explaining the manufacturing process of the chip varistors according to the present embodiment. The present manufacturing process up to the preparation of the laminate body LB is the same as the manufacturing process of the first embodiment described above, and thus the description of the steps up to it is omitted herein.

The laminate body LB in which the varistor green layer L1 and the conductor green layers L2 are laminated together is prepared as shown in FIG. 14. Then the laminate body LB is dried and thereafter cut in chip units, as shown in FIG. 15, to obtain a plurality of green element bodies GC (element bodies 3 before fired). The cutting of the laminate body LB is carried out, for example, with a dicing saw or the like.

Next, the plurality of green element bodies GC are subjected to a thermal treatment under predetermined conditions to implement debindering, and thereafter further fired under predetermined conditions. This firing process results in turning the varistor green layer L1 consisting of the first green sheets into the varistor section 7 and turning the conductor green layers L2 consisting of the second green sheets into the electroconductive sections 9, thereby obtaining a plurality of element bodies 3 in each of which the varistor section 7 is sandwiched in between the electroconductive sections 9. The varistor green layer L1 and the conductor green layers L2 are fired together. After the firing, the element bodies 3 may be polished by barrel polishing if necessary. The barrel polishing may be carried out before the firing, i.e., after the cutting of the laminate body LB. The conditions for the thermal treatment and the firing are the same as in the aforementioned first embodiment.

Next, an electroconductive paste is applied so as to cover the two end faces 3*a*, 3*b* of each element body 3 and thermally treated to bake the electroconductive paste on the element body 3 to form the first electrode layers 5*a*. Thereafter, electroplating treatments such as Ni plating and Sn plating are carried out so as to cover the first electrode layers 5*a*, thereby forming the second and third electrode layers 5*b*, 5*c*. These steps result in forming the terminal electrodes 5 on both end sides of the element body 3. The terminal electrodes 5 are formed on the both end sides in the direction in which the varistor section 7 is sandwiched in between the electroconductive sections 9, in the element body 3. The electroconductive paste can be, for example, one in which a glass fit and an organic vehicle are mixed in a metal powder. The metal powder can be, for example, one containing Cu, Ag, or an Ag—Pd alloy as a major component.

Next, at least one element selected from the group consisting of alkali metals (e.g., Li, Na, etc.), Ag, and Cu is diffused through the exposed surface (four side faces 3*c*-3*f*) of each element body 3. The below will describe an example in which an alkali metal is diffused.

First, an alkali metal compound is deposited on the surface (four side faces 3*c*-3*f*) of the element body 3 with the terminal electrodes 5 thereon. The deposition of the alkali metal compound can be implemented using a hermetically closed rotary pot. There are no particular restrictions on the alkali metal compound but it can be a compound to allow the alkali metal to diffuse through the surface of the element body 3 by a thermal treatment, e.g., an oxide, hydroxide, chloride, nitrite, borate, carbonate, or oxalate of the alkali metal.

Then the element body 3 with this alkali metal compound deposited thereon is thermally treated at a predetermined temperature for a predetermined time in an electric furnace. This treatment results in diffusing the alkali metal from the alkali metal compound into the interior through the surface (four side faces 3*c*-3*f*) of the element body 3. The thermal treatment temperature is preferably in the range of 700 to 1000° C. and a preferred thermal treatment atmosphere is the atmosphere. The thermal treatment time (retention time) is preferably from ten minutes to four hours.

Portions where the alkali metal element diffuses into the element body 3 (varistor section 7 and electroconductive sections 9), i.e., the first regions 8*a*, 10*a* where the alkali metal element exists come to have higher resistance and lower capacitance as described above. Since the end faces 3*a*, 3*b* of the element body 3 (principal surfaces 9*b* of the electroconductive sections 9) are covered by the terminal electrodes 5, the alkali metal element does not diffuse through the end faces 3*a*, 3*b*. Therefore, the alkali metal element does not hinder the electrical connection between the terminal electrodes 5 and the electroconductive sections 9 (second regions 8*b*, 10*b*).

The chip varistors 1B are obtained through these steps.

In the present embodiment, as described above, as in the aforementioned embodiment, the chip varistor 1B, different from the so-called multilayer chip varistors, exhibits the varistor characteristics, without inclusion of the internal electrodes. For this reason, even if a surge voltage such as ESD is applied, the electric field distribution will be concentrated nowhere in the varistor section 7, so as to cause no degradation of ESD resistance.

In the present embodiment, the varistor section 7 and the electroconductive sections 9 include the first regions 8*a*, 10*a*, respectively. The first regions 8*a*, 10*a* have the lower electric conductivity and lower relative permittivity. The capacitance of the chip varistor 1B can be expressed by the sum of respective capacitances of the varistor section 7 and the electroconductive sections 9 located between the terminal electrodes 5. Therefore, since the varistor section 7 and the electroconductive sections 9 include the first regions 8*a*, 10*a*, the respective capacitances of the varistor section 7 and the electroconductive sections 9 become lower, so as to decrease the capacitance of the chip varistor 1B.

Since the chip varistor 1B is not provided with any internal electrodes, it is free of variation in capacitance due to the internal electrodes as in the case of the aforementioned first embodiment.

In the present embodiment, the first region 8*a* of the varistor section 7 is located on the exterior surface side of the varistor section 7 so as to surround the outer periphery of the second region 8*b*, when viewed from the opposing direction of the pair of principal surfaces 7*a*, 7*b*. Since the electric conductivity is lower on the exterior surface side of the varistor section 7, surface current is less likely to flow on the exterior surface of the varistor section 7. As a result, it is feasible to suppress occurrence of leak current in the chip varistor 1B.

In the present embodiment, since the varistor section 7 and the electroconductive sections 9 are also comprised of the sintered bodies consisting mainly of ZnO, the connection strength becomes firm at the interfaces between the varistor section 7 and the electroconductive sections 9. As a result, the varistor section 7 and the electroconductive sections 9 are connected well, so as to prevent occurrence of delamination between the varistor section 7 and the electroconductive sections 9.

In the present embodiment, the electroconductive sections 9 (sintered bodies) substantially contain no rare earth metal, either, and thus the electroconductive sections 9 are unlikely to exhibit the varistor characteristics, and have relatively high electrical conductivity. Therefore, the function as electrodes is not hindered in the electroconductive sections 9.

In the present embodiment, the at least one element selected from the group consisting of alkali metals, Ag, and Cu is diffused through the external surface (side faces 3*c*-3*f*) of the element body 3. For this reason, it is feasible to readily control the range where the at least one element selected from the group consisting of alkali metals, Ag, and Cu is diffused.

Figure 16:
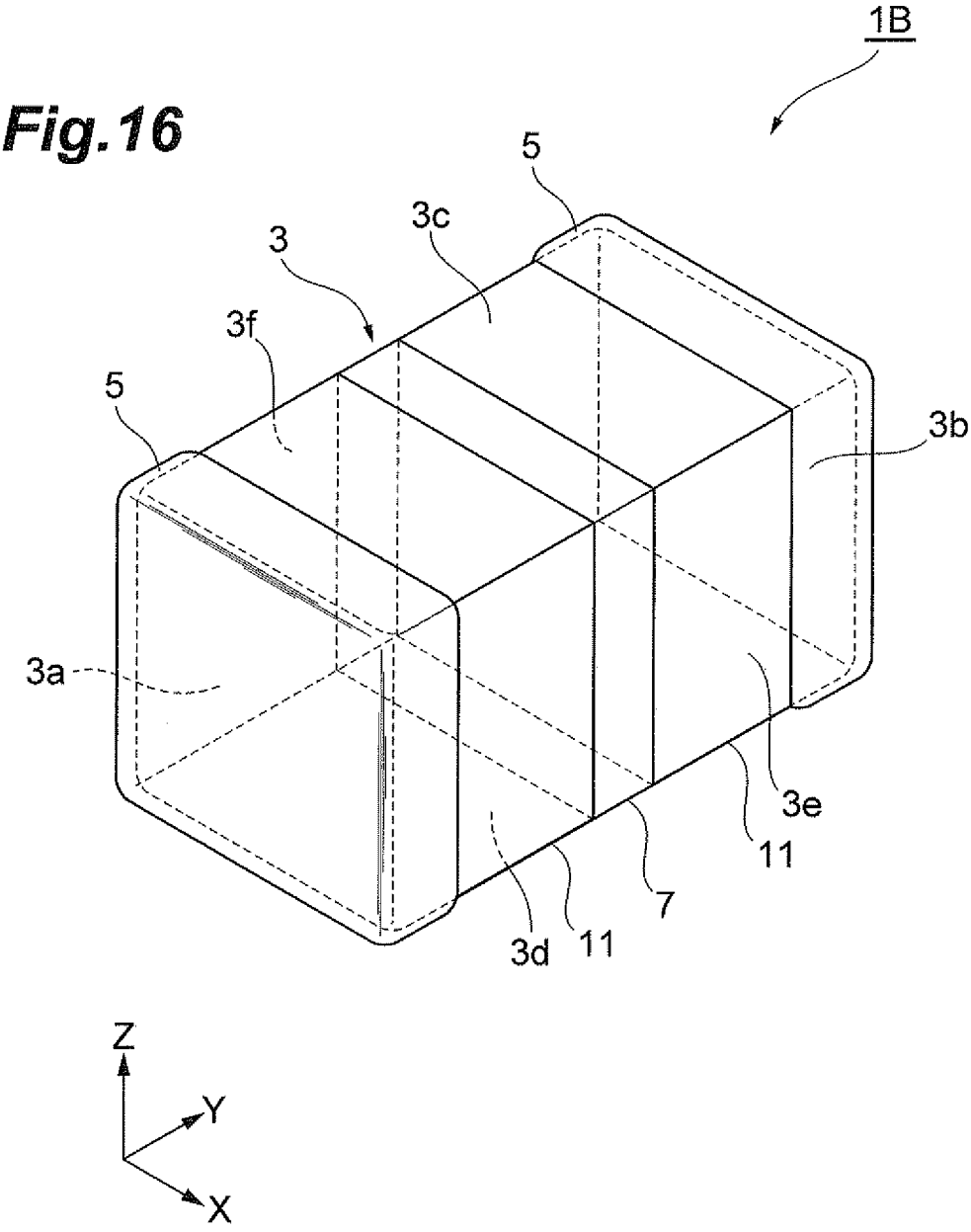
FIG. 16 is a perspective view showing a chip varistor according to a modification example of the second embodiment.
Figure 17:
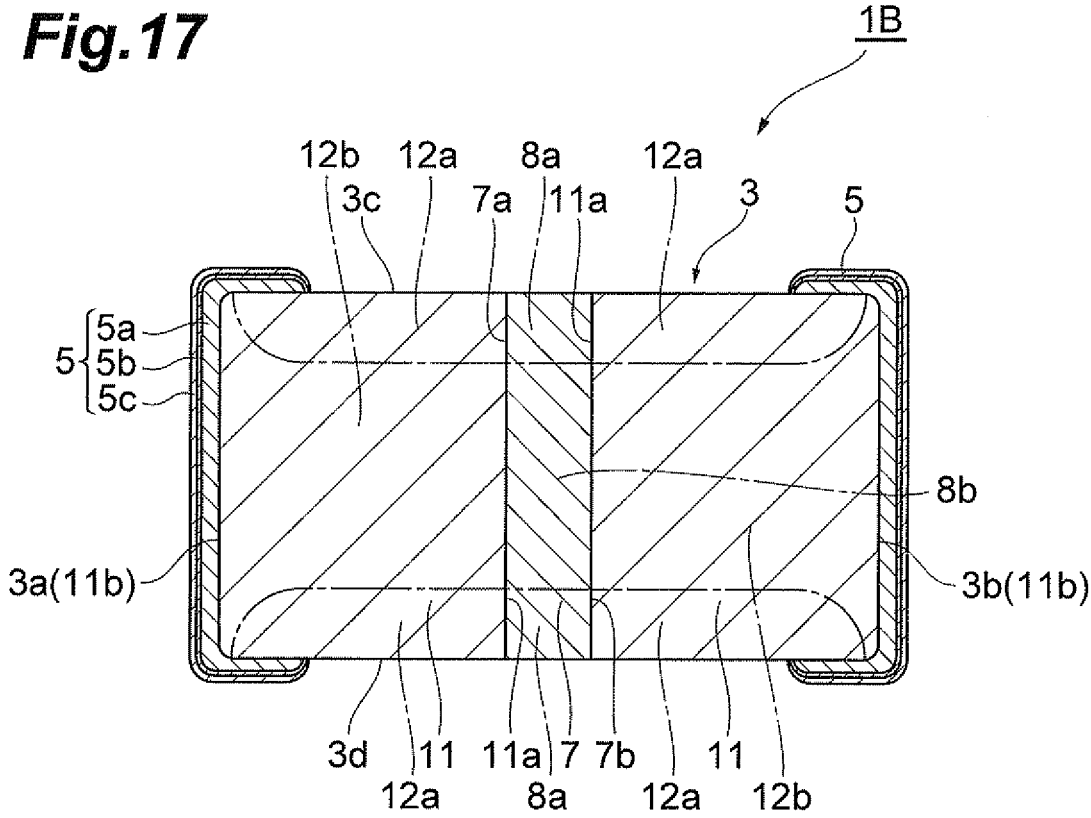
FIG. 17 is a drawing for explaining a cross-sectional configuration of the chip varistor according to the modification example of the second embodiment.
Figure 18:
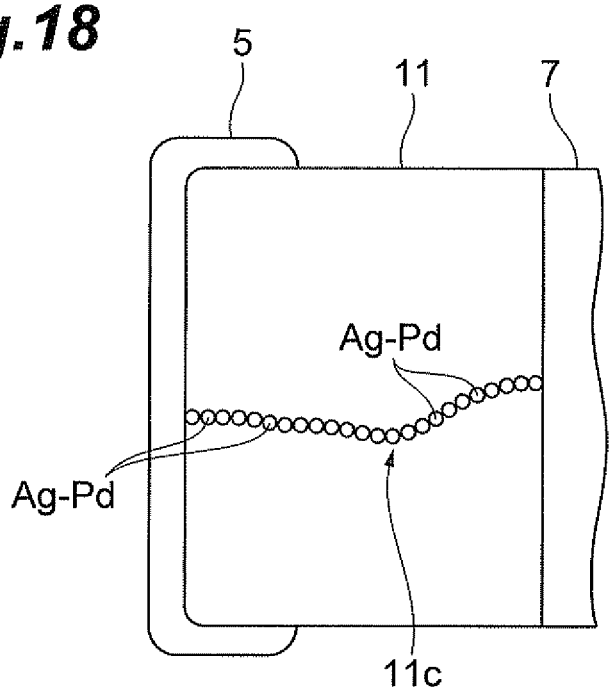
FIG. 18 is a schematic cross-sectional view showing an electroconductive passage in a composite section of the chip varistor according to the second embodiment.

The below will describe a configuration of chip varistor 1B according to a modification example of the second embodiment, with reference to FIGS. 16 and 17. FIG. 16 is a perspective view showing the chip varistor according to the modification example of the second embodiment. FIG. 17 is a drawing for explaining a cross-sectional configuration of the chip varistor according to the modification example of the second embodiment.

The chip varistor 1B of the modification example, as shown in FIGS. 16 and 17, is also provided with an element body 3 of a nearly rectangular parallelepiped shape and a pair of terminal electrodes 5 formed at two ends of the element body 3. The element body 3 has a varistor section 7 and a plurality of composite sections 11 (two composite sections in the present embodiment).

The varistor section 7 includes a first region 8*a* and a second region 8*b* as in the aforementioned second embodiment. The second region 8*b* of the varistor section 7 extends between the principal surfaces 11*a* of the composite sections 11 to be connected to the composite sections 11 (principal surfaces 11*a*).

Figure 19:
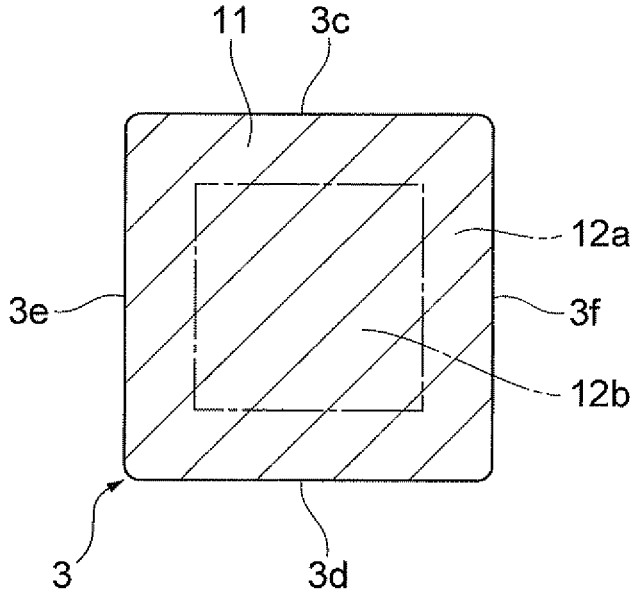
FIG. 19 is a drawing for explaining a cross-sectional configuration of a composite section in the chip varistor according to the second embodiment.

The composite sections 11, as also shown in FIG. 19, includes a first region 12*a* and a second region 12*b*. The first region 12*a* contains at least one element selected from the group consisting of alkali metals, Ag, and Cu. In the first region 12*a*, the at least one element selected from the group consisting of alkali metals, Ag, and Cu exists in a solid solution form in crystal grains of ZnO or exists at crystal grain boundaries of ZnO. The second region 12*b* contains no element selected from the group consisting of alkali metals, Ag, and Cu. In the present modification example, the foregoing element to be used is also an alkali metal, particularly, Li. The first region 12*a* may contain two or more elements selected from the group consisting of alkali metals, Ag, and Cu.

In each composite section 11, the second region 12*b*, as shown in FIG. 19, is located approximately in the center of the composite section 11, when viewed from the opposing direction of the pair of principal surfaces 11*b*. The second region 12*b* extends between the principal surface 11*a* and the principal surface 11*b*, when viewed from the direction perpendicular to the opposing direction of the pair of principal surfaces 11*b*. Namely, the second region 12*b* is connected to the second region 8*b* of the varistor section 7 and to the terminal electrode 5. The first region 12*a* is located on the exterior surface side of the composite section 11 so as to surround the outer periphery of the second region 12*b*, when viewed from the opposing direction of the pair of principal surfaces 11*b*. The first region 12*a*, as described above, has lower electric conductivity and lower capacitance than the second region 12*b*. In the composite section 11, the second region 12*b* functions mainly as an electrode (conductor).

Figure 20:
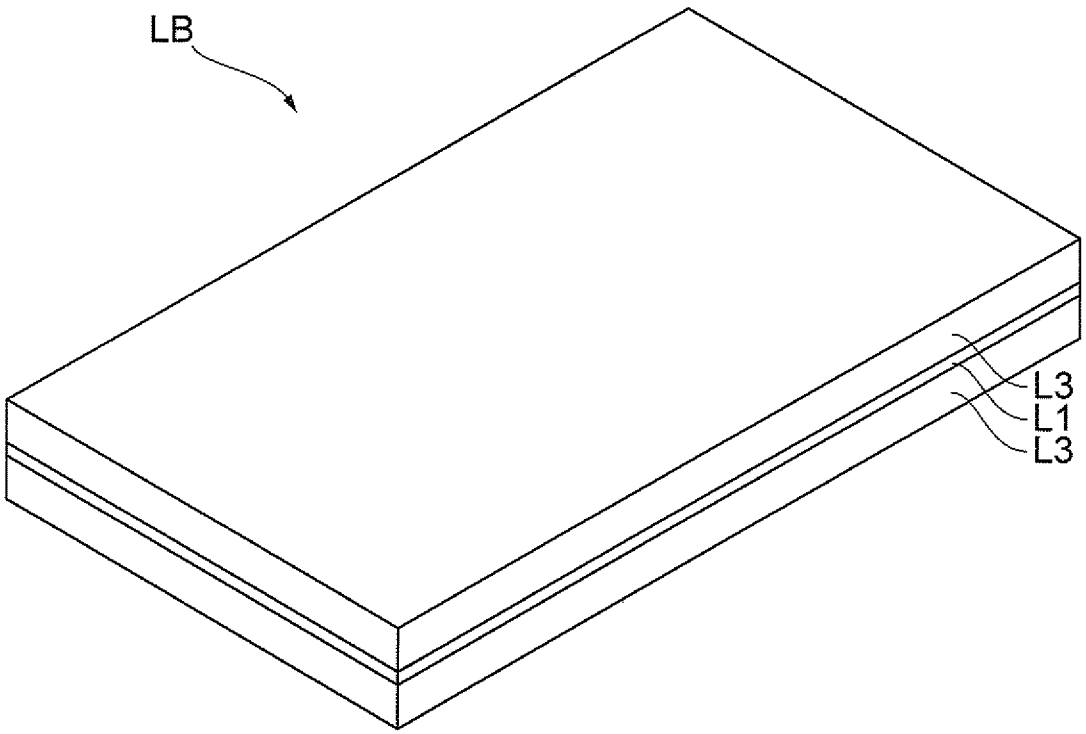
FIG. 20 is a drawing for explaining a manufacturing process of the chip varistors according to the modification example of the second embodiment.
Figure 21:
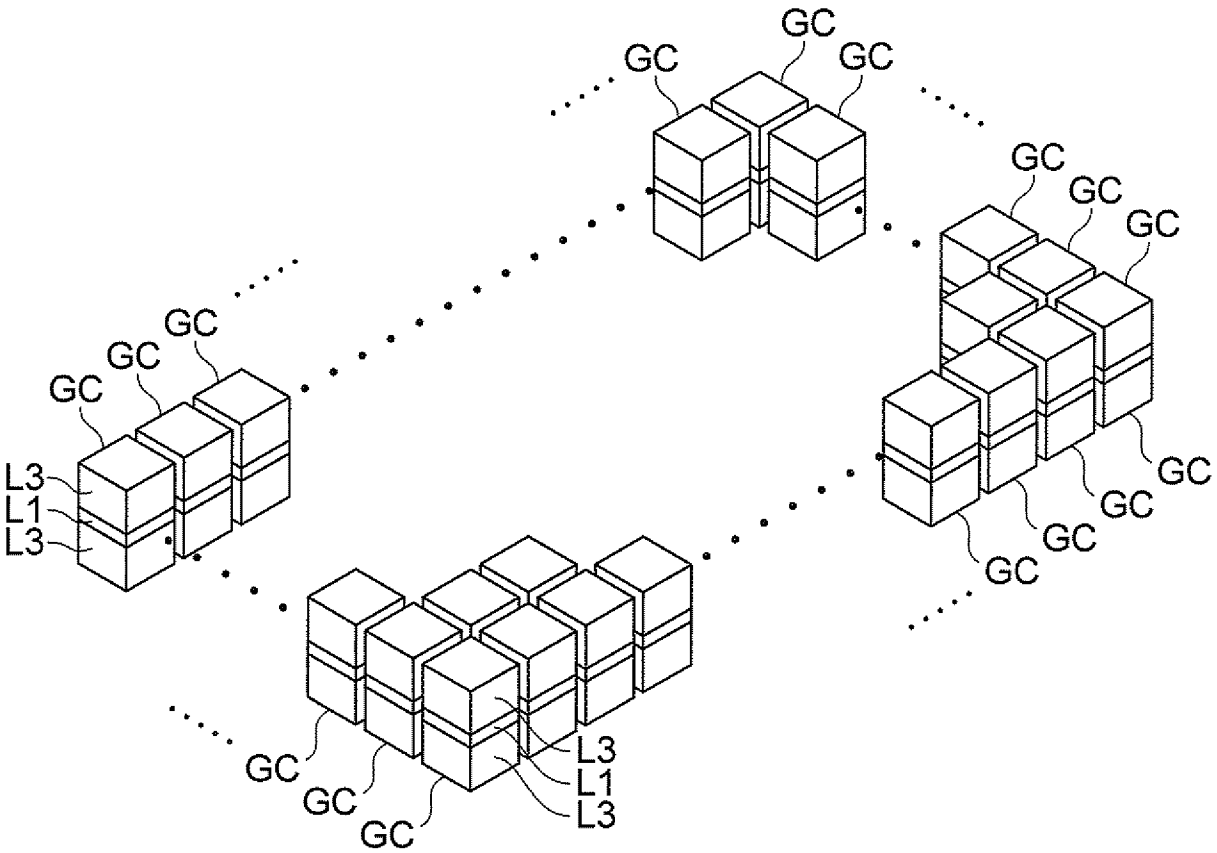
FIG. 21 is a drawing for explaining the manufacturing process of the chip varistors according to the modification example of the second embodiment.

The below will describe an example of a manufacturing process of the chip varistors 1B according to the present modification example, with reference to FIGS. 20 and 21. FIGS. 20 and 21 are drawings for explaining the manufacturing process of the chip varistors according to the modification example of the second embodiment. The present manufacturing process up to the preparation of the laminate body LB is the same as the manufacturing process of the modification example of the first embodiment and the description of the steps up to it is omitted herein.

The laminate body LB in which the varistor green layer L1 and the composite green layers L3 are laminated together is prepared as shown in FIG. 20. Then the laminate body LB is dried and thereafter cut in chip units, as shown in FIG. 21, to obtain a plurality of green element bodies GC (element bodies 3 before fired).

Next, the plurality of green element bodies GC are subjected to a thermal treatment under predetermined conditions to implement debindering, and then further fired under predetermined conditions. This firing process results in turning the varistor green layer L1 of the first green sheets into the varistor section 7 and the composite green layers L3 of the second green sheets into the composite sections 11, thereby obtaining a plurality of element bodies 3 in each of which the varistor section 7 is sandwiched in between the composite sections 11. The varistor green layer L1 and the composite green layers L3 are fired together. The conditions for the thermal treatment and the firing are the same as in the aforementioned first and second embodiments.

Next, the terminal electrodes 5 are formed on each element body 3 (composite sections 11) in the same manner as in the aforementioned embodiments. Thereafter, at least one element selected from the group consisting of alkali metals (e.g., Li, Na, etc.), Ag, and Cu is diffused through the exposed surface (four side faces 3*c*-3*f*) of the element body 3.

The portions where the above element diffuses in the composite sections 11, i.e., the first regions 12*a* where the foregoing element exists come to have higher resistance and lower capacitance as the first region 8*a* of the varistor section 7 does. Since the end faces 3*a*, 3*b* of each element body 3 (principal surfaces 11*b* of the composite sections 11) are covered by the terminal electrodes 5, the foregoing element does not diffuse through the end faces 3*a*, 3*b*. Therefore, the alkali metal does not hinder the electric connection between the terminal electrodes 5 and the composite sections 11 (second regions 12*b*).

The chip varistors 1B according to the modification example are obtained through these steps.

In the present modification example, as described above, the chip varistor 1B, different from the so-called multilayer chip varistors, also exhibits the varistor characteristics, without inclusion of any internal electrodes. For this reason, even if a surge voltage such as ESD is applied to the chip varistor 1B, the electric field distribution will be concentrated nowhere in the varistor section, so as to cause no degradation of ESD resistance.

In the present modification example, the varistor section 7 and the composite sections 11 include the first regions 8*a*, 12*a*, respectively. The first regions 8*a*, 12*a* have lower electric conductivity and lower relative permittivity than the second regions 8*b*, 12*b*. The capacitance of the chip varistor 1B can be expressed by the sum of respective capacitances of the varistor section 7 and the composite sections 11 located between the terminal electrodes 5. Therefore, since the varistor section 7 and the composite sections 11 include the respective first regions 8*a*, 12*a*, the respective capacitances of the varistor section 7 and the composite sections 11 become lower, so as to decrease the capacitance of the chip varistor 1B.

Since the chip varistor 1B of the present modification example is not provided with any internal electrodes, it is feasible to prevent occurrence of variation in capacitance.

Since in the present modification example the composite sections 11 are comprised of the composite material of the Ag—Pd alloy and ZnO, heat in the chip varistor 1B is readily dissipated through the composite sections, whereby the chip varistor 1B can be obtained with excellent heat dissipation.

In the present modification example, since the varistor section 7 and the composite sections 11 also contain ZnO, the connection strength becomes firm at the interfaces between the varistor section 7 and the composite sections 11. For this reason, the varistor section 7 and the composite sections 11 are connected well, so as to prevent occurrence of delamination between the varistor section 7 and the composite sections 11.

Each of the chip varistors 1B according to the present embodiment and the modification example is also mounted by soldering so that the opposing direction of the electroconductive sections 9 is parallel to a mounting surface of an external substrate or the like. Since the varistor section 7 is located nearly in the center of the element body 3, when viewed from the opposing direction of the (electroconductive sections 9 or the composite sections 11), a solder is less likely to reach the varistor section 7 on the occasion of a soldering. As a result, the chip varistor 1B can prevent the solder from adhering to the varistor section 7 in solder mounting and thereby hindering the function of the varistor section 7.

The above described the preferred embodiments of the present invention, but it should be noted that the present invention is not always limited to the above-described embodiments but may be modified in may ways without departing from the scope and spirit of the invention.

In the embodiments and modification examples the pair of electroconductive sections (electroconductive sections 9 or composite sections 11) arranged on both sides of the varistor section 7 have the same configuration, but they do not always have to be limited to this configuration. For example, one of the electroconductive sections may be configured as the electroconductive section 9 and the other electroconductive section as the composite section 11.

The varistor section 7 may contain Bi, instead of the rare earth metal. In this case, as described above, the electroconductive sections 9 preferably do not contain Bi. The varistor section 7 may contain the rare earth metal and Bi. In this case, the electroconductive sections 9 preferably do not contain the rare earth metal and Bi.

In the second embodiment and the modification example thereof, the first region 8*a*, 10*a*, 12*a* is located on the exterior surface side of the element body 3 so as to surround the outer periphery of the second region 8*b*, 10*b*, 12*b*, when viewed from the opposing direction of the pair of end faces 3*a*, 3*b*, but they are not limited to this configuration. For example, the first region may be located on the side of one side face out of the four side faces 3*c*-3*f* or on the sides of two side faces out of the four side faces 3*c*-3*f*.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A chip varistor comprising:

a varistor section comprised of a sintered body containing ZnO as a major component and configured to exhibit the nonlinear voltage-current characteristics;

a plurality of electroconductive sections arranged on both sides of the varistor section and each having a first principal surface connected to the varistor section and a second principal surface opposed to the first principal surface; and a plurality of terminal electrodes connected to the respective second principal surfaces of the plurality of electroconductive sections, wherein the varistor section includes a first region in which at least one element selected from the group consisting of alkali metals Ag, and Cu exists and a second region extending between the first principal surfaces of the electroconductive sections and containing no element selected from the group consisting of alkali metals, Ag, and Cu, and each of the electroconductive sections includes a first region in which at least one element selected from the group consisting of alkali metals, Ag, and Cu exists, and a second region extending between the first principal surface and the second principal surface and containing no element selected from the group consisting of alkali metals, Ag, and Cu.

2. The chip varistor according to claim 1, wherein the electroconductive sections contain ZnO as a major component.

3. The chip varistor according to claim 2, wherein the varistor section contains at least one element selected from the group consisting of rare earth metals and Bi, as a minor component, and wherein at least one electroconductive section out of the plurality of electroconductive sections is comprised of a sintered body substantially containing none of the rare earth metals and Bi, as a minor component.

4. The chip varistor according to claim 1, wherein the electroconductive sections are comprised of a composite material of a metal and a metal oxide.

5. The chip varistor according to claim 1, wherein the first region of the varistor section is located on the exterior surface side of the varistor section so as to surround the outer periphery of the second region of the varistor section, when viewed from a direction in which the varistor section is sandwiched in between the electroconductive sections.

6. A chip varistor manufacturing method comprising:

a step of preparing a laminate body in which conductor green layers and a varistor green layer are laminated together so that the varistor green layer to become a varistor section containing ZnO as a major component and configured to exhibit the nonlinear voltage-current characteristics is sandwiched in between the conductor green layers to become electroconductive sections;

a step of cutting the laminate body to acquire a plurality of green element bodies;

a step of firing the plurality of green element bodies to acquire a plurality of element bodies in each of which the varistor section is sandwiched in between the electroconductive sections;

a step of forming terminal electrodes on both end sides in a direction in which the varistor section is sandwiched in between the electroconductive sections, in each of the plurality of element bodies; and a step of diffusing at least one element selected from the group consisting of alkali metals, Ag, and Cu, through the exterior surface of the element body, in each of the plurality of element bodies, after the step of forming the terminal electrodes.

* * * * *